US008807785B2

(12) United States Patent
Ivey et al.

(10) Patent No.: US 8,807,785 B2
(45) Date of Patent: Aug. 19, 2014

(54) ELECTRIC SHOCK RESISTANT L.E.D. BASED LIGHT

(71) Applicant: iLumisys, Inc., Troy, MI (US)

(72) Inventors: John Ivey, Farmington Hills, MI (US); Dennis Siemiet, Rochester Hills, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

(21) Appl. No.: 13/742,678

(22) Filed: Jan. 16, 2013

(65) Prior Publication Data

US 2013/0128574 A1 May 23, 2013

Related U.S. Application Data

(63) Continuation of application No. 12/126,579, filed on May 23, 2008, now Pat. No. 8,360,599.

(51) Int. Cl.
*F21V 29/00* (2006.01)

(52) U.S. Cl.
USPC ..... 362/218; 362/217.02

(58) Field of Classification Search
CPC .... F21S 8/031; F21S 4/003; F21Y 2103/003; F21Y 2103/00; F21V 19/008; F21V 29/225; F21V 7/043; F21V 19/0075
USPC ..... 362/217.01–219, 217.12–217.17
See application file for complete search history.

(56) References Cited

U.S. PATENT DOCUMENTS

| | | | |
|---|---|---|---|
| D54,511 | S | 2/1920 | Owen |
| D58,105 | S | 6/1921 | Poritz |
| D79,814 | S | 8/1929 | Hoch |

(Continued)

FOREIGN PATENT DOCUMENTS

| | | | |
|---|---|---|---|
| CN | 1584388 | A | 2/2005 |
| CN | 2766345 | Y | 3/2006 |

(Continued)

OTHER PUBLICATIONS

Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.

(Continued)

*Primary Examiner* — Julie Bannan
(74) *Attorney, Agent, or Firm* — Young Basile

(57) ABSTRACT

An LED-based light comprises: a tubular housing formed of a high-dielectric material and defined at least in part by a light transmitting portion; an elongate circuit board disposed within the housing; at least one LED mounted on the circuit board; an elongate heat sink disposed within the housing, the heat sink having an interior circuit board mounting surface opposing a radially outer surface, the circuit board mounted in thermally conductive relation to the circuit board mounting surface, substantially all of the radially outer surface of the heat sink in thermally conductive relation with the tubular housing for electrically insulated thermal transmission of heat generated by the LED from the circuit board to an ambient environment surrounding the LED-based light; and a pair of end caps disposed on opposing ends of the housing with connectors configured to physically connect the LED-based light to a conventional fluorescent light fixture.

17 Claims, 5 Drawing Sheets

(56) References Cited

U.S. PATENT DOCUMENTS

| | | | |
|---|---|---|---|
| D80,419 | S | 1/1930 | Kramer |
| D84,763 | S | 7/1931 | Stange |
| D119,797 | S | 4/1940 | Winkler et al. |
| D125,312 | S | 2/1941 | Logan |
| 2,826,679 | A | 3/1958 | Irmischer et al. |
| 2,909,097 | A | 10/1959 | Alden et al. |
| 3,178,622 | A | 4/1965 | Paul et al. |
| 3,272,977 | A | 9/1966 | Holmes |
| 3,318,185 | A | 5/1967 | Kott |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,821,590 | A | 6/1974 | Kosman et al. |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,009,394 | A | 2/1977 | Mierzwinski |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,257,672 | A | 3/1981 | Balliet |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Nishizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quella et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,650,971 | A | 3/1987 | Manecci et al. |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,727,457 | A | 2/1988 | Thillays |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,767,172 | A | 8/1988 | Hubble, III et al. |
| 4,771,274 | A | 9/1988 | Havel |
| 4,780,621 | A | 10/1988 | Bartleucci et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,847,536 | A | 7/1989 | Lowe et al. |
| 4,851,972 | A | 7/1989 | Altman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,920,459 | A | 4/1990 | Rothwell et al. |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,001,609 | A | 3/1991 | Gardner et al. |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |
| 5,034,807 | A | 7/1991 | Von Kohorn |
| 5,036,248 | A | 7/1991 | McEwan et al. |
| 5,038,255 | A | 8/1991 | Nishihashi et al. |
| 5,065,226 | A | 11/1991 | Kluitmans et al. |
| 5,072,216 | A | 12/1991 | Grange |
| 5,078,039 | A | 1/1992 | Tulk et al. |
| 5,083,063 | A | 1/1992 | Brooks |
| 5,088,013 | A | 2/1992 | Revis |
| 5,089,748 | A | 2/1992 | Ihms |
| 5,103,382 | A | 4/1992 | Kondo et al. |
| 5,122,733 | A | 6/1992 | Havel |
| 5,126,634 | A | 6/1992 | Johnson |

(56) References Cited

U.S. PATENT DOCUMENTS

| | | | |
|---|---|---|---|
| 5,128,595 | A | 7/1992 | Hara |
| 5,130,761 | A | 7/1992 | Tanaka |
| 5,130,909 | A | 7/1992 | Gross |
| 5,134,387 | A | 7/1992 | Smith et al. |
| 5,136,483 | A | 8/1992 | Schoniger et al. |
| 5,140,220 | A | 8/1992 | Hasegawa |
| 5,142,199 | A | 8/1992 | Elwell |
| 5,151,679 | A | 9/1992 | Dimmick |
| 5,154,641 | A | 10/1992 | McLaughlin |
| 5,161,879 | A | 11/1992 | McDermott |
| 5,161,882 | A | 11/1992 | Garrett |
| 5,164,715 | A | 11/1992 | Kashiwabara et al. |
| 5,184,114 | A | 2/1993 | Brown |
| 5,194,854 | A | 3/1993 | Havel |
| 5,198,756 | A | 3/1993 | Jenkins et al. |
| 5,209,560 | A | 5/1993 | Taylor et al. |
| 5,220,250 | A | 6/1993 | Szuba |
| 5,225,765 | A | 7/1993 | Callahan et al. |
| 5,226,723 | A | 7/1993 | Chen |
| 5,254,910 | A | 10/1993 | Yang |
| 5,256,948 | A | 10/1993 | Boldin et al. |
| 5,268,828 | A | 12/1993 | Miura |
| 5,278,542 | A | 1/1994 | Smith et al. |
| 5,282,121 | A | 1/1994 | Bornhorst et al. |
| 5,283,517 | A | 2/1994 | Havel |
| 5,287,352 | A | 2/1994 | Jackson et al. |
| 5,294,865 | A | 3/1994 | Haraden |
| 5,298,871 | A | 3/1994 | Shimohara |
| 5,301,090 | A | 4/1994 | Hed |
| 5,303,124 | A | 4/1994 | Wrobel |
| 5,307,295 | A | 4/1994 | Taylor et al. |
| 5,321,593 | A | 6/1994 | Moates |
| 5,323,226 | A | 6/1994 | Schreder |
| 5,329,431 | A | 7/1994 | Taylor et al. |
| 5,344,068 | A | 9/1994 | Haessig |
| 5,350,977 | A | 9/1994 | Hamamoto et al. |
| 5,357,170 | A | 10/1994 | Luchaco et al. |
| 5,365,411 | A | 11/1994 | Rycroft et al. |
| 5,371,618 | A | 12/1994 | Tai et al. |
| 5,374,876 | A | 12/1994 | Horibata et al. |
| 5,375,043 | A | 12/1994 | Tokunaga |
| D354,360 | S | 1/1995 | Murata |
| 5,381,074 | A | 1/1995 | Rudzewicz et al. |
| 5,388,357 | A | 2/1995 | Malita |
| 5,402,702 | A | 4/1995 | Hata |
| 5,404,094 | A | 4/1995 | Green et al. |
| 5,404,282 | A | 4/1995 | Klinke et al. |
| 5,406,176 | A | 4/1995 | Sugden |
| 5,410,328 | A | 4/1995 | Yoksza et al. |
| 5,412,284 | A | 5/1995 | Moore et al. |
| 5,412,552 | A | 5/1995 | Fernandes |
| 5,420,482 | A | 5/1995 | Phares |
| 5,421,059 | A | 6/1995 | Leffers, Jr. |
| 5,430,356 | A | 7/1995 | Ference et al. |
| 5,432,408 | A | 7/1995 | Matsuda et al. |
| 5,436,535 | A | 7/1995 | Yang |
| 5,436,853 | A | 7/1995 | Shimohara |
| 5,450,301 | A | 9/1995 | Waltz et al. |
| 5,461,188 | A | 10/1995 | Drago et al. |
| 5,463,280 | A | 10/1995 | Johnson |
| 5,463,502 | A | 10/1995 | Savage, Jr. |
| 5,465,144 | A | 11/1995 | Parker et al. |
| 5,473,522 | A | 12/1995 | Kriz et al. |
| 5,475,300 | A | 12/1995 | Havel |
| 5,481,441 | A | 1/1996 | Stevens |
| 5,489,827 | A | 2/1996 | Xia |
| 5,491,402 | A | 2/1996 | Small |
| 5,493,183 | A | 2/1996 | Kimball |
| 5,504,395 | A | 4/1996 | Johnson et al. |
| 5,506,760 | A | 4/1996 | Giebler et al. |
| 5,513,082 | A | 4/1996 | Asano |
| 5,519,496 | A | 5/1996 | Borgert et al. |
| 5,530,322 | A | 6/1996 | Ference et al. |
| 5,539,628 | A | 7/1996 | Seib |
| 5,544,809 | A | 8/1996 | Keating et al. |
| 5,545,950 | A | 8/1996 | Cho |
| 5,550,440 | A | 8/1996 | Allison et al. |
| 5,559,681 | A | 9/1996 | Duarte |
| 5,561,346 | A | 10/1996 | Byrne |
| D376,030 | S | 11/1996 | Cohen |
| 5,575,459 | A | 11/1996 | Anderson |
| 5,575,554 | A | 11/1996 | Guritz |
| 5,581,158 | A | 12/1996 | Quazi |
| 5,592,051 | A | 1/1997 | Korkala |
| 5,592,054 | A | 1/1997 | Nerone et al. |
| 5,600,199 | A | 2/1997 | Martin, Sr. et al. |
| 5,607,227 | A | 3/1997 | Yasumoto et al. |
| 5,608,290 | A | 3/1997 | Hutchisson et al. |
| 5,614,788 | A | 3/1997 | Mullins et al. |
| 5,621,282 | A | 4/1997 | Haskell |
| 5,621,603 | A | 4/1997 | Adamec et al. |
| 5,621,662 | A | 4/1997 | Humphries et al. |
| 5,622,423 | A | 4/1997 | Lee |
| 5,633,629 | A | 5/1997 | Hochstein |
| 5,634,711 | A | 6/1997 | Kennedy et al. |
| 5,639,158 | A | 6/1997 | Sato |
| 5,640,061 | A | 6/1997 | Bornhorst et al. |
| 5,640,141 | A | 6/1997 | Myllymaki |
| 5,640,792 | A | 6/1997 | O'Shea |
| 5,642,129 | A | 6/1997 | Zavracky et al. |
| 5,655,830 | A | 8/1997 | Ruskouski |
| 5,656,935 | A | 8/1997 | Havel |
| 5,661,374 | A | 8/1997 | Cassidy et al. |
| 5,661,645 | A | 8/1997 | Hochstein |
| 5,673,059 | A | 9/1997 | Zavracky et al. |
| 5,682,103 | A | 10/1997 | Burrell |
| 5,684,523 | A | 11/1997 | Satoh et al. |
| 5,688,042 | A | 11/1997 | Madadi et al. |
| 5,690,417 | A | 11/1997 | Choate |
| 5,697,695 | A | 12/1997 | Lin et al. |
| 5,701,058 | A | 12/1997 | Roth |
| 5,712,650 | A | 1/1998 | Barlow |
| 5,713,655 | A | 2/1998 | Blackman |
| 5,721,471 | A | 2/1998 | Begemann et al. |
| 5,725,148 | A | 3/1998 | Hartman |
| 5,726,535 | A | 3/1998 | Yan |
| 5,731,759 | A | 3/1998 | Finucan |
| 5,734,590 | A | 3/1998 | Tebbe |
| 5,751,118 | A | 5/1998 | Mortimer |
| 5,752,766 | A | 5/1998 | Bailey et al. |
| 5,765,940 | A | 6/1998 | Levy et al. |
| 5,769,527 | A | 6/1998 | Taylor et al. |
| 5,784,006 | A | 7/1998 | Hochstein |
| 5,785,227 | A | 7/1998 | Akiba |
| 5,790,329 | A | 8/1998 | Klaus et al. |
| 5,803,579 | A | 9/1998 | Turnbull et al. |
| 5,803,580 | A | 9/1998 | Tseng |
| 5,803,729 | A | 9/1998 | Tsimerman |
| 5,806,965 | A | 9/1998 | Deese |
| 5,808,689 | A | 9/1998 | Small |
| 5,810,463 | A | 9/1998 | Kawahara et al. |
| 5,812,105 | A | 9/1998 | Van de Ven |
| 5,813,751 | A | 9/1998 | Shaffer |
| 5,813,753 | A | 9/1998 | Vriens et al. |
| 5,821,695 | A | 10/1998 | Vilanilam et al. |
| 5,825,051 | A | 10/1998 | Bauer et al. |
| 5,828,178 | A | 10/1998 | York et al. |
| 5,831,522 | A | 11/1998 | Weed et al. |
| 5,836,676 | A | 11/1998 | Ando et al. |
| 5,848,837 | A | 12/1998 | Gustafson |
| 5,850,126 | A | 12/1998 | Kanbar |
| 5,851,063 | A | 12/1998 | Doughty et al. |
| 5,852,658 | A | 12/1998 | Knight et al. |
| 5,854,542 | A | 12/1998 | Forbes |
| RE36,030 | E | 1/1999 | Nadeau |
| 5,859,508 | A | 1/1999 | Ge et al. |
| 5,865,529 | A | 2/1999 | Yan |
| 5,890,794 | A | 4/1999 | Abtahi et al. |
| 5,893,633 | A | 4/1999 | Saito et al. |
| 5,896,010 | A | 4/1999 | Mikolajczak et al. |
| 5,904,415 | A | 5/1999 | Robertson et al. |
| 5,907,742 | A | 5/1999 | Johnson et al. |
| 5,909,378 | A | 6/1999 | De Milleville |
| 5,912,653 | A | 6/1999 | Fitch |

(56) References Cited

U.S. PATENT DOCUMENTS 5,917,287 A 6/1999 Haederle et al.
5,917,534 A 6/1999 Rajeswaran
5,921,660 A 7/1999 Yu
5,924,784 A 7/1999 Chliwnyj et al.
5,927,845 A 7/1999 Gustafson et al.
5,934,792 A 8/1999 Camarota
5,936,599 A 8/1999 Reymond
5,943,802 A 8/1999 Tijanic
5,946,209 A 8/1999 Eckel et al.
5,949,347 A 9/1999 Wu
5,951,145 A 9/1999 Iwasaki et al.
5,952,680 A 9/1999 Strite
5,959,547 A 9/1999 Tubel et al.
5,961,072 A 10/1999 Bodle
5,962,989 A 10/1999 Baker
5,962,992 A 10/1999 Huang et al.
5,963,185 A 10/1999 Havel
5,966,069 A 10/1999 Zmurk et al.
5,974,553 A 10/1999 Gandar
5,980,064 A 11/1999 Metroyanis
5,998,925 A 12/1999 Shimizu et al.
5,998,928 A 12/1999 Hipp
6,000,807 A 12/1999 Moreland
6,007,209 A 12/1999 Pelka
6,008,783 A 12/1999 Kitagawa et al.
6,010,228 A 1/2000 Blackman et al.
6,011,691 A 1/2000 Schreffler
6,016,038 A 1/2000 Mueller et al.
6,018,237 A 1/2000 Havel
6,019,493 A 2/2000 Kuo et al.
6,020,825 A 2/2000 Chansky et al.
6,025,550 A 2/2000 Kato
6,028,694 A 2/2000 Schmidt
6,030,099 A 2/2000 McDermott
6,031,343 A 2/2000 Recknagel et al.
6,031,958 A 2/2000 McGaffigan
6,036,335 A 3/2000 Openiano
6,036,336 A 3/2000 Wu
D422,737 S 4/2000 Orozco
6,056,420 A 5/2000 Wilson et al.
6,068,383 A 5/2000 Robertson et al.
6,069,597 A 5/2000 Hansen
6,072,280 A 6/2000 Allen
6,084,359 A 7/2000 Hetzel et al.
6,086,220 A 7/2000 Lash et al.
6,091,200 A 7/2000 Lenz
6,092,915 A 7/2000 Rensch
6,095,661 A 8/2000 Lebens et al.
6,097,352 A 8/2000 Zavracky et al.
6,115,184 A 9/2000 Hubble, III et al.
6,116,748 A 9/2000 George
6,121,875 A 9/2000 Hamm et al.
6,127,783 A 10/2000 Pashley et al.
6,132,072 A 10/2000 Turnbull et al.
6,135,604 A 10/2000 Lin
6,135,620 A 10/2000 Marsh
6,139,174 A 10/2000 Butterworth
6,149,283 A 11/2000 Conway et al.
6,150,774 A 11/2000 Mueller et al.
6,151,529 A 11/2000 Batko
6,153,985 A 11/2000 Grossman
6,158,882 A 12/2000 Bischoff, Jr.
6,166,496 A 12/2000 Lys et al.
6,175,201 B1 1/2001 Sid
6,175,220 B1 1/2001 Billig et al.
6,181,126 B1 1/2001 Havel
D437,947 S 2/2001 Huang
6,183,086 B1 2/2001 Neubert
6,183,104 B1 2/2001 Ferrara
6,184,628 B1 2/2001 Ruthenberg
6,196,471 B1 3/2001 Ruthenberg
6,203,180 B1 3/2001 Fleischmann
6,211,626 B1 4/2001 Lys et al.
6,215,409 B1 4/2001 Blach
6,217,190 B1 4/2001 Altman et al.
6,219,239 B1 4/2001 Mellberg et al.
6,227,679 B1 5/2001 Zhang et al.
6,234,645 B1 5/2001 Börner et al.
6,238,075 B1 5/2001 Dealey, Jr. et al.
6,240,665 B1 6/2001 Brown et al.
6,241,359 B1 6/2001 Lin
6,249,221 B1 6/2001 Reed
6,250,774 B1 6/2001 Begemann et al.
6,252,350 B1 6/2001 Alvarez
6,252,358 B1 6/2001 Xydis et al.
6,268,600 B1 7/2001 Nakamura et al.
6,273,338 B1 8/2001 White
6,275,397 B1 8/2001 McClain
6,283,612 B1 9/2001 Hunter
6,292,901 B1 9/2001 Lys et al.
6,293,684 B1 9/2001 Riblett
6,297,724 B1 10/2001 Bryans et al.
6,305,109 B1 10/2001 Lee
6,305,821 B1 10/2001 Hsieh et al.
6,307,331 B1 10/2001 Bonasia et al.
6,310,590 B1 10/2001 Havel
6,315,429 B1 11/2001 Grandolfo
6,323,832 B1 11/2001 Nishizawa et al.
6,325,651 B1 12/2001 Nishihara et al.
6,334,699 B1 1/2002 Gladnick
6,340,868 B1 1/2002 Lys et al.
6,354,714 B1 3/2002 Rhodes
6,361,186 B1 3/2002 Slayden
6,362,578 B1 3/2002 Swanson et al.
6,369,525 B1 4/2002 Chang et al.
6,371,637 B1 4/2002 Atchinson et al.
6,373,733 B1 4/2002 Wu et al.
6,379,022 B1 4/2002 Amerson et al.
6,380,865 B1 4/2002 Pederson
D457,667 S 5/2002 Piepgras et al.
D457,669 S 5/2002 Piepgras et al.
D457,974 S 5/2002 Piepgras et al.
6,388,393 B1 5/2002 Illingworth
6,394,623 B1 5/2002 Tsui
6,396,216 B1 5/2002 Noone et al.
D458,395 S 6/2002 Piepgras et al.
6,400,096 B1 6/2002 Wells et al.
6,404,131 B1 6/2002 Kawano et al.
6,411,022 B1 6/2002 Machida
6,411,045 B1 6/2002 Nerone
6,422,716 B2 7/2002 Henrici et al.
6,428,189 B1 8/2002 Hochstein
6,429,604 B1 8/2002 Chang
D463,610 S 9/2002 Piepgras et al.
6,445,139 B1 9/2002 Marshall et al.
6,448,550 B1 9/2002 Nishimura
6,448,716 B1 9/2002 Hutchison
6,459,919 B1 10/2002 Lys et al.
6,464,373 B1 10/2002 Petrick
6,469,457 B2 10/2002 Callahan
6,471,388 B1 10/2002 Marsh
6,472,823 B2 * 10/2002 Yen ..... 315/112
6,473,002 B1 10/2002 Hutchison
D468,035 S 12/2002 Blanc et al.
6,488,392 B1 12/2002 Lu
6,495,964 B1 12/2002 Muthu et al.
6,511,204 B2 1/2003 Emmel et al.
6,517,218 B2 2/2003 Hochstein
6,521,879 B1 2/2003 Rand et al.
6,527,411 B1 3/2003 Sayers
6,528,954 B1 3/2003 Lys et al.
6,528,958 B2 3/2003 Hulshof et al.
6,538,375 B1 3/2003 Duggal et al.
6,540,381 B1 4/2003 Douglass, II
6,541,800 B2 4/2003 Barnett et al.
6,548,967 B1 4/2003 Dowling et al.
6,568,834 B1 5/2003 Scianna
6,573,536 B1 6/2003 Dry
6,577,072 B2 6/2003 Saito et al.
6,577,080 B2 6/2003 Lys et al.
6,577,512 B2 6/2003 Tripathi et al.
6,577,794 B1 6/2003 Currie et al.
6,578,979 B2 6/2003 Truttmann-Battig
6,582,103 B1 6/2003 Popovich et al.

(56) References Cited

U.S. PATENT DOCUMENTS 6,583,550 B2 6/2003 Iwasa et al.
6,583,573 B2 6/2003 Bierman
D477,093 S 7/2003 Moriyama et al.
6,585,393 B1 7/2003 Brandes et al.
6,586,890 B2 7/2003 Min et al.
6,590,343 B2 7/2003 Pederson
6,592,238 B2 7/2003 Cleaver et al.
6,596,977 B2 7/2003 Muthu et al.
6,598,996 B1 7/2003 Lodhie
6,608,453 B2 8/2003 Morgan et al.
6,608,614 B1 8/2003 Johnson
6,609,804 B2 8/2003 Nolan et al.
6,609,813 B1 8/2003 Showers et al.
6,612,712 B2 9/2003 Nepil
6,612,717 B2 * 9/2003 Yen ..... 362/245
6,612,729 B1 9/2003 Hoffman
6,621,222 B1 9/2003 Hong
6,623,151 B2 9/2003 Pederson
6,624,597 B2 9/2003 Dowling et al.
D481,484 S 10/2003 Cuevas et al.
6,634,770 B2 10/2003 Cao
6,634,779 B2 10/2003 Reed
6,636,003 B2 10/2003 Rahm et al.
6,639,349 B1 10/2003 Bahadur
6,641,284 B2 11/2003 Stopa et al.
6,652,117 B2 11/2003 Tsai
6,659,622 B2 12/2003 Katogi et al.
6,660,935 B2 12/2003 Southard et al.
6,666,689 B1 12/2003 Savage, Jr.
6,667,623 B2 12/2003 Bourgault et al.
6,674,096 B2 1/2004 Sommers
6,676,284 B1 1/2004 Wynne Willson
6,679,621 B2 1/2004 West et al.
6,681,154 B2 1/2004 Nierlich et al.
6,682,205 B2 1/2004 Lin
6,683,419 B2 1/2004 Kriparos
6,700,136 B2 3/2004 Guida
6,712,486 B1 3/2004 Popovich et al.
6,717,376 B2 4/2004 Lys et al.
6,717,526 B2 4/2004 Martineau et al.
6,720,745 B2 4/2004 Lys et al.
6,726,348 B2 4/2004 Gloisten
6,736,525 B2 5/2004 Chin
6,741,324 B1 5/2004 Kim
D491,678 S 6/2004 Piepgras
D492,042 S 6/2004 Piepgras
6,744,223 B2 6/2004 Laflamme et al.
6,748,299 B1 6/2004 Motoyama
6,762,562 B2 7/2004 Leong
6,768,047 B2 7/2004 Chang et al.
6,774,584 B2 8/2004 Lys et al.
6,777,891 B2 8/2004 Lys et al.
6,781,329 B2 8/2004 Mueller et al.
6,787,999 B2 9/2004 Stimac et al.
6,788,000 B2 9/2004 Appelberg et al.
6,788,011 B2 9/2004 Mueller et al.
6,791,840 B2 9/2004 Chun
6,796,680 B1 9/2004 Showers et al.
6,799,864 B2 10/2004 Bohler et al.
6,801,003 B2 10/2004 Schanberger et al.
6,803,732 B2 10/2004 Kraus et al.
6,806,659 B1 10/2004 Mueller et al.
6,814,470 B2 11/2004 Rizkin et al.
6,814,478 B2 11/2004 Menke
6,815,724 B2 11/2004 Dry
6,846,094 B2 1/2005 Luk
6,851,816 B2 2/2005 Wu et al.
6,851,832 B2 2/2005 Tieszen
6,853,150 B2 2/2005 Clauberg et al.
6,853,151 B2 2/2005 Leong et al.
6,853,563 B1 2/2005 Yang et al.
6,857,924 B2 2/2005 Fu et al.
6,860,628 B2 3/2005 Robertson et al.
6,866,401 B2 3/2005 Sommers et al.
6,869,204 B2 3/2005 Morgan et al.
6,871,981 B2 3/2005 Alexanderson et al.
6,874,924 B1 4/2005 Hulse et al.
6,879,883 B1 4/2005 Motoyama
6,882,111 B2 4/2005 Kan et al.
6,883,929 B2 4/2005 Dowling
6,883,934 B2 4/2005 Kawakami et al.
6,888,322 B2 5/2005 Dowling et al.
6,897,624 B2 5/2005 Lys et al.
D506,274 S 6/2005 Moriyama et al.
6,909,239 B2 6/2005 Gauna
6,909,921 B1 6/2005 Bilger
6,918,680 B2 7/2005 Seeberger
6,921,181 B2 7/2005 Yen
6,926,419 B2 8/2005 An
6,936,968 B2 8/2005 Cross et al.
6,936,978 B2 8/2005 Morgan et al.
6,940,230 B2 9/2005 Myron et al.
6,948,829 B2 9/2005 Verdes et al.
6,953,261 B1 10/2005 Jiao et al.
6,957,905 B1 10/2005 Pritchard et al.
6,963,175 B2 11/2005 Archenhold et al.
6,964,501 B2 11/2005 Ryan
6,965,197 B2 11/2005 Tyan et al.
6,965,205 B2 11/2005 Piepgras et al.
6,967,448 B2 11/2005 Morgan et al.
6,969,179 B2 11/2005 Sloan et al.
6,969,186 B2 11/2005 Sonderegger et al.
6,969,954 B2 11/2005 Lys
6,975,079 B2 12/2005 Lys et al.
6,979,097 B2 12/2005 Elam et al.
6,982,518 B2 1/2006 Chou et al.
6,995,681 B2 2/2006 Pederson
6,997,576 B1 2/2006 Lodhie et al.
6,999,318 B2 2/2006 Newby
7,004,603 B2 2/2006 Knight
D518,218 S 3/2006 Roberge et al.
7,008,079 B2 3/2006 Smith
7,014,336 B1 3/2006 Ducharme et al.
7,015,650 B2 3/2006 McGrath
7,018,063 B2 3/2006 Michael et al.
7,018,074 B2 3/2006 Raby et al.
7,021,799 B2 4/2006 Mizuyoshi
7,021,809 B2 4/2006 Iwasa et al.
7,024,256 B2 4/2006 Krzyzanowski et al.
7,031,920 B2 4/2006 Dowling et al.
7,033,036 B2 4/2006 Pederson
7,038,398 B1 5/2006 Lys et al.
7,038,399 B2 5/2006 Lys et al.
7,042,172 B2 5/2006 Dowling et al.
7,048,423 B2 5/2006 Stepanenko et al.
7,049,761 B2 5/2006 Timmermans et al.
7,052,171 B1 5/2006 Lefebvre et al.
7,053,557 B2 5/2006 Cross et al.
7,064,498 B2 6/2006 Dowling et al.
7,064,674 B2 6/2006 Pederson
7,067,992 B2 6/2006 Leong et al.
7,077,978 B2 7/2006 Setlur et al.
7,080,927 B2 7/2006 Feuerborn et al.
7,086,747 B2 8/2006 Nielson et al.
7,088,014 B2 8/2006 Nierlich et al.
7,088,904 B2 8/2006 Ryan, Jr.
7,102,902 B1 9/2006 Brown et al.
7,113,541 B1 9/2006 Lys et al.
7,114,830 B2 10/2006 Robertson et al.
7,114,834 B2 10/2006 Rivas et al.
7,118,262 B2 10/2006 Negley
7,119,503 B2 10/2006 Kemper
7,120,560 B2 10/2006 Williams et al.
7,121,679 B2 10/2006 Fujimoto
7,122,976 B1 10/2006 Null et al.
7,128,442 B2 10/2006 Lee et al.
7,128,454 B2 10/2006 Kim et al.
D532,532 S 11/2006 Maxik
7,132,635 B2 11/2006 Dowling
7,132,785 B2 11/2006 Ducharme
7,132,804 B2 11/2006 Lys et al.
7,135,824 B2 11/2006 Lys et al.
7,139,617 B1 11/2006 Morgan et al.
7,144,135 B2 12/2006 Martin et al.

(56) References Cited

U.S. PATENT DOCUMENTS

| | | | |
|---|---|---|---|
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,165,863 | B1 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich |
| 7,211,959 | B1 | 5/2007 | Chou et al. |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Martineau et al. |
| 7,237,925 | B2 | 7/2007 | Mayer et al. |
| 7,239,532 | B1 | 7/2007 | Hsu et al. |
| 7,241,038 | B2 | 7/2007 | Naniwa et al. |
| 7,242,152 | B2 | 7/2007 | Dowling et al. |
| 7,244,058 | B2 | 7/2007 | DiPenti et al. |
| 7,246,926 | B2 | 7/2007 | Harwood |
| 7,246,931 | B2 | 7/2007 | Hsieh et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| 7,274,183 | B1 | 9/2007 | Gu et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| D574,093 | S | 7/2008 | Kitagawa et al. |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,466,082 | B1 | 12/2008 | Snyder et al. |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 * | 1/2009 | Chan ..... 362/240 |
| 7,478,924 | B2 | 1/2009 | Robertson |
| D586,484 | S | 2/2009 | Liu et al. |
| D586,928 | S | 2/2009 | Liu et al. |
| 7,490,957 | B2 | 2/2009 | Leong et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Glovatsky et al. |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |

(56) References Cited

U.S. PATENT DOCUMENTS

D593,223 S 5/2009 Komar
7,530,701 B2 5/2009 Chan-Wing
7,534,002 B2 5/2009 Yamaguchi et al.
D594,999 S 6/2009 Uchida et al.
7,549,769 B2 6/2009 Kim et al.
7,556,396 B2 7/2009 Kuo et al.
7,559,663 B2 7/2009 Wong et al.
7,562,998 B1 7/2009 Yen
D597,686 S 8/2009 Noh
7,569,981 B1 8/2009 Ciancanelli
7,572,030 B2 8/2009 Booth et al.
7,575,339 B2 8/2009 Hung
7,579,786 B2 8/2009 Soos
7,583,035 B2 9/2009 Shteynberg et al.
7,583,901 B2 9/2009 Nakagawa et al.
7,594,738 B1 9/2009 Lin et al.
D601,726 S 10/2009 Mollaert et al.
7,598,681 B2 10/2009 Lys et al.
7,598,684 B2 10/2009 Lys et al.
7,598,686 B2 10/2009 Lys et al.
7,600,907 B2 10/2009 Liu et al.
7,602,559 B2 10/2009 Jang et al.
7,618,157 B1 11/2009 Galvez et al.
7,619,366 B2 11/2009 Diederiks
7,635,201 B2 12/2009 Deng
7,635,214 B2 12/2009 Perlo
7,639,517 B2 12/2009 Zhou et al.
7,648,251 B2 1/2010 Whitehouse et al.
7,649,327 B2 1/2010 Peng
D610,724 S 2/2010 Chiang et al.
7,661,839 B2 2/2010 Tsai
D612,528 S 3/2010 McGrath et al.
7,690,813 B2 4/2010 Kanamori et al.
7,710,047 B2 5/2010 Shteynberg et al.
7,710,253 B1 5/2010 Fredricks
7,712,918 B2 5/2010 Siemiet et al.
7,748,886 B2 7/2010 Pazula et al.
7,758,207 B1 7/2010 Zhou et al.
7,759,881 B1 7/2010 Melanson
D621,975 S 8/2010 Wang
7,784,966 B2 8/2010 Verfuerth et al.
7,800,511 B1 9/2010 Hutchison et al.
7,815,338 B2 10/2010 Siemiet et al.
7,815,341 B2 10/2010 Steedly et al.
7,828,471 B2 11/2010 Lin
7,843,150 B2 11/2010 Wang et al.
7,848,702 B2 12/2010 Ho et al.
7,850,341 B2 12/2010 Mrakovich et al.
RE42,161 E 2/2011 Hochstein
7,878,683 B2 2/2011 Logan et al.
7,887,216 B2 2/2011 Patrick
7,887,226 B2 2/2011 Huang et al.
7,889,051 B1 2/2011 Billig et al.
D634,452 S 3/2011 de Visser
7,926,975 B2 4/2011 Siemiet et al.
7,938,562 B2 5/2011 Ivey et al.
7,946,729 B2 5/2011 Ivey et al.
7,976,196 B2 7/2011 Ivey et al.
7,990,070 B2 8/2011 Nerone
7,997,770 B1 8/2011 Meurer
8,013,472 B2 9/2011 Adest et al.
D650,097 S 12/2011 Trumble et al.
D650,494 S 12/2011 Tsao et al.
D652,968 S 1/2012 Aguiar et al.
8,093,823 B1 1/2012 Ivey et al.
D654,192 S 2/2012 Maxik et al.
8,118,447 B2 2/2012 Simon et al.
8,159,152 B1 4/2012 Salessi
D660,472 S 5/2012 Aguiar et al.
8,167,452 B2 5/2012 Chou
8,177,388 B2 5/2012 Yen
8,179,037 B2 5/2012 Chan et al.
8,183,989 B2 5/2012 Tsai
D662,236 S 6/2012 Matsushita
8,203,445 B2 6/2012 Recker et al.
8,214,084 B2 7/2012 Ivey et al.
8,235,539 B2 8/2012 Thomas et al.
8,247,985 B2 8/2012 Timmermans et al.
8,262,249 B2 9/2012 Hsia et al.
8,272,764 B2 9/2012 Son
8,287,144 B2 10/2012 Pedersen et al.
8,297,788 B2 10/2012 Bishop
8,299,722 B2 10/2012 Melanson
8,304,993 B2 11/2012 Tzou et al.
8,313,213 B2 11/2012 Lin et al.
8,319,407 B2 * 11/2012 Ke ..... 313/45
8,319,433 B2 11/2012 Lin et al.
8,319,437 B2 11/2012 Carlin et al.
8,322,878 B2 12/2012 Hsia et al.
8,324,817 B2 12/2012 Ivey et al.
8,337,071 B2 12/2012 Negley et al.
8,376,579 B2 2/2013 Chang
8,376,588 B2 2/2013 Yen
8,382,322 B2 2/2013 Bishop
8,382,327 B2 2/2013 Timmermans et al.
8,382,502 B2 2/2013 Cao et al.
8,388,179 B2 3/2013 Hood et al.
8,398,275 B2 3/2013 Wang et al.
8,403,692 B2 3/2013 Cao et al.
8,405,314 B2 3/2013 Jensen
8,434,914 B2 5/2013 Li et al.
8,454,193 B2 6/2013 Simon et al.
2001/0033488 A1 10/2001 Chliwnyj et al.
2001/0045803 A1 11/2001 Cencur
2002/0011801 A1 1/2002 Chang
2002/0015297 A1 2/2002 Hayashi et al.
2002/0038157 A1 3/2002 Dowling et al.
2002/0044066 A1 4/2002 Dowling et al.
2002/0047516 A1 4/2002 Iwasa et al.
2002/0047569 A1 4/2002 Dowling et al.
2002/0047624 A1 4/2002 Stam et al.
2002/0047628 A1 4/2002 Morgan et al.
2002/0048169 A1 4/2002 Dowling et al.
2002/0057061 A1 5/2002 Mueller et al.
2002/0060526 A1 5/2002 Timmermans et al.
2002/0070688 A1 6/2002 Dowling et al.
2002/0074559 A1 6/2002 Dowling et al.
2002/0074958 A1 6/2002 Crenshaw
2002/0078221 A1 6/2002 Blackwell et al.
2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling et al.
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171378 A1 11/2002 Morgan et al.
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten

(56) References Cited

U.S. PATENT DOCUMENTS

2003/0189412 A1 10/2003 Cunningham
2003/0218879 A1 11/2003 Tieszen
2003/0222587 A1 12/2003 Dowling, Jr. et al.
2003/0234342 A1 12/2003 Gaines et al.
2004/0003545 A1 1/2004 Gillespie
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi et al.
2004/0155609 A1 8/2004 Lys et al.
2004/0160199 A1 8/2004 Morgan et al.
2004/0178751 A1 9/2004 Mueller et al.
2004/0189218 A1 9/2004 Leong et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St.-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0242742 A1 11/2005 Cheang et al.
2005/0243577 A1 11/2005 Moon
2005/0248299 A1 11/2005 Chemel et al.
2005/0253533 A1 11/2005 Lys et al.
2005/0259424 A1 11/2005 Zampini, II et al.
2005/0264474 A1 12/2005 Rast
2005/0265019 A1 12/2005 Sommers et al.
2005/0275626 A1 12/2005 Mueller et al.
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.
2006/0126338 A1 6/2006 Mighetto
2006/0132061 A1 6/2006 McCormick et al.
2006/0132323 A1 6/2006 Grady, Jr.
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0215422 A1 9/2006 Laizure, Jr. et al.
2006/0220595 A1 10/2006 Lu
2006/0221606 A1 10/2006 Dowling et al.
2006/0221619 A1 10/2006 Nishigaki
2006/0227558 A1 10/2006 Osawa et al.
2006/0232974 A1 10/2006 Lee et al.
2006/0238884 A1 10/2006 Jang et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0265921 A1 11/2006 Korall et al.
2006/0273741 A1 12/2006 Stalker, III
2006/0274529 A1 12/2006 Cao
2006/0285325 A1 12/2006 Ducharme et al.
2007/0035255 A1 2/2007 Shuster et al.
2007/0035538 A1 2/2007 Garcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0064425 A1 3/2007 Frecska et al.
2007/0070621 A1 3/2007 Rivas et al.
2007/0070631 A1 3/2007 Huang et al.

(56) References Cited

U.S. PATENT DOCUMENTS

2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120594 A1 5/2007 Balakrishnan et al.
2007/0127234 A1 6/2007 Jervey, III
2007/0133202 A1 6/2007 Huang et al.
2007/0139938 A1 6/2007 Petroski et al.
2007/0145915 A1 6/2007 Roberge et al.
2007/0147046 A1 6/2007 Arik et al.
2007/0152797 A1 7/2007 Chemel et al.
2007/0152808 A1 7/2007 LaCasse
2007/0153514 A1 7/2007 Dowling et al.
2007/0159828 A1 7/2007 Wang
2007/0165402 A1 7/2007 Weaver, Jr. et al.
2007/0165405 A1 7/2007 Chen
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0029720 A1 2/2008 Li
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 de Castris
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0310119 A1 12/2008 Giacoma
2008/0315773 A1 12/2008 Pang
2008/0315784 A1 12/2008 Tseng
2009/0002995 A1 1/2009 Lee et al.
2009/0010022 A1 1/2009 Tsai
2009/0016063 A1 1/2009 Hu
2009/0021140 A1 1/2009 Takasu et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0067170 A1 3/2009 Bloemen et al.
2009/0067182 A1 3/2009 Hsu et al.
2009/0085500 A1 4/2009 Zampini, II et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0295776 A1 12/2009 Yu et al.
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046210 A1 2/2010 Mathai et al.
2010/0046222 A1 2/2010 Yang
2010/0073944 A1 3/2010 Chen
2010/0079085 A1 4/2010 Wendt et al.
2010/0096992 A1 4/2010 Yamamoto et al.
2010/0096998 A1 4/2010 Beers

(56) References Cited

U.S. PATENT DOCUMENTS

| | | | |
|---|---|---|---|
| 2010/0103664 | A1 | 4/2010 | Simon et al. |
| 2010/0103673 | A1 | 4/2010 | Ivey et al. |
| 2010/0109550 | A1 | 5/2010 | Huda et al. |
| 2010/0109558 | A1 | 5/2010 | Chew |
| 2010/0141173 | A1 | 6/2010 | Negrete |
| 2010/0148650 | A1 | 6/2010 | Wu et al. |
| 2010/0149806 | A1 | 6/2010 | Yiu |
| 2010/0157608 | A1 | 6/2010 | Chen et al. |
| 2010/0164404 | A1 | 7/2010 | Shao et al. |
| 2010/0181178 | A1 | 7/2010 | Chang et al. |
| 2010/0201269 | A1 | 8/2010 | Tzou et al. |
| 2010/0207547 | A1 | 8/2010 | Kuroki et al. |
| 2010/0220469 | A1 | 9/2010 | Ivey et al. |
| 2010/0237790 | A1 | 9/2010 | Peng |
| 2010/0265732 | A1 | 10/2010 | Liu |
| 2010/0270925 | A1 | 10/2010 | Withers |
| 2010/0277069 | A1 | 11/2010 | Janik et al. |
| 2010/0289418 | A1 | 11/2010 | Langovsky |
| 2010/0308733 | A1 | 12/2010 | Shao |
| 2010/0309652 | A1 | 12/2010 | Shen et al. |
| 2010/0320922 | A1 | 12/2010 | Palazzolo et al. |
| 2011/0006658 | A1 | 1/2011 | Chan et al. |
| 2011/0090682 | A1 | 4/2011 | Zheng et al. |
| 2011/0109454 | A1 | 5/2011 | McSheffrey, Sr. et al. |
| 2011/0112661 | A1 | 5/2011 | Jung et al. |
| 2011/0156584 | A1 | 6/2011 | Kim |
| 2011/0176298 | A1 | 7/2011 | Meurer et al. |
| 2011/0199723 | A1 | 8/2011 | Sato |
| 2011/0199769 | A1 | 8/2011 | Bretschneider et al. |
| 2011/0291588 | A1 | 12/2011 | Tagare |
| 2012/0014086 | A1 | 1/2012 | Jonsson |
| 2012/0043892 | A1 | 2/2012 | Visser et al. |
| 2012/0063140 | A1 | 3/2012 | Kong |
| 2012/0080994 | A1 | 4/2012 | Chin et al. |
| 2012/0081891 | A1 | 4/2012 | Tung et al. |
| 2012/0098439 | A1 | 4/2012 | Recker et al. |
| 2012/0106144 | A1 | 5/2012 | Chang |
| 2012/0113628 | A1 | 5/2012 | Burrow et al. |
| 2012/0127726 | A1 | 5/2012 | Yen |
| 2012/0146503 | A1 | 6/2012 | Negley et al. |
| 2012/0147597 | A1 | 6/2012 | Farmer |
| 2012/0153865 | A1 | 6/2012 | Rolfes et al. |
| 2012/0155073 | A1 | 6/2012 | Mccanless et al. |
| 2012/0161666 | A1 | 6/2012 | Antony et al. |
| 2012/0194086 | A1 | 8/2012 | Liu et al. |
| 2012/0195032 | A1 | 8/2012 | Shew |
| 2012/0212951 | A1 | 8/2012 | Lai et al. |
| 2012/0212953 | A1 | 8/2012 | Bloom et al. |
| 2012/0230044 | A1 | 9/2012 | Zhang et al. |
| 2012/0236533 | A1 | 9/2012 | Nakamura et al. |
| 2012/0236554 | A1 | 9/2012 | Rust |
| 2012/0243216 | A1 | 9/2012 | Lai et al. |
| 2012/0243217 | A1 | 9/2012 | Szprengiel et al. |
| 2012/0274214 | A1 | 11/2012 | Radermacher et al. |
| 2012/0275154 | A1 | 11/2012 | Hood et al. |
| 2012/0293991 | A1 | 11/2012 | Lin |
| 2012/0293996 | A1 | 11/2012 | Thomas et al. |
| 2012/0300445 | A1 | 11/2012 | Chu et al. |
| 2012/0300468 | A1 | 11/2012 | Chang et al. |
| 2012/0307524 | A1 | 12/2012 | Schapira et al. |
| 2012/0320598 | A1 | 12/2012 | Son |
| 2013/0039051 | A1 | 2/2013 | Wu |
| 2013/0044471 | A1 | 2/2013 | Chen |
| 2013/0044476 | A1 | 2/2013 | Bretschneider et al. |
| 2013/0050997 | A1 | 2/2013 | Bretschneider et al. |
| 2013/0050998 | A1 | 2/2013 | Chu et al. |
| 2013/0057146 | A1 | 3/2013 | Chao |
| 2013/0058079 | A1 | 3/2013 | Dellian et al. |
| 2013/0063944 | A1 | 3/2013 | Lodhie et al. |
| 2013/0077297 | A1 | 3/2013 | Wu et al. |
| 2013/0094200 | A1 | 4/2013 | Dellian et al. |
| 2013/0148349 | A1 | 6/2013 | Pasqualini et al. |
| 2013/0201690 | A1 | 8/2013 | Vissenberg et al. |
| 2013/0221867 | A1 | 8/2013 | Deppe et al. |
| 2013/0258668 | A1 | 10/2013 | Dellian et al. |

FOREIGN PATENT DOCUMENTS

| | | | |
|---|---|---|---|
| CN | 2869556 | Y | 2/2007 |
| CN | 10106976 | A | 8/2007 |
| CN | 101075605 | A | 11/2007 |
| CN | 201129681 | Y | 10/2008 |
| CN | 201184574 | Y | 1/2009 |
| CN | 101737664 | A1 | 6/2010 |
| DE | 19651140 | A1 | 6/1997 |
| DE | 19624087 | A1 | 12/1997 |
| DE | 29819966 | U1 | 3/1999 |
| DE | 29900320 | U1 | 5/1999 |
| DE | 29817609 | U1 | 1/2000 |
| DE | 20018865 | U1 | 2/2001 |
| EP | 0013782 | B1 | 3/1983 |
| EP | 0091172 | A2 | 10/1983 |
| EP | 0124924 | B1 | 9/1987 |
| EP | 0174699 | B1 | 11/1988 |
| EP | 0390262 | B1 | 10/1990 |
| EP | 0197602 | B1 | 11/1990 |
| EP | 0214701 | B1 | 3/1992 |
| EP | 0262713 | B1 | 6/1992 |
| EP | 0203668 | B1 | 2/1993 |
| EP | 0272749 | B1 | 8/1993 |
| EP | 0337567 | B1 | 11/1993 |
| EP | 0390262 | B1 | 12/1993 |
| EP | 0578302 | B1 | 1/1994 |
| EP | 0359329 | B1 | 3/1994 |
| EP | 0403011 | B1 | 4/1994 |
| EP | 0632511 | A2 | 1/1995 |
| EP | 0432848 | B1 | 4/1995 |
| EP | 0403001 | B1 | 5/1995 |
| EP | 0659531 | A1 | 6/1995 |
| EP | 0525876 | B1 | 5/1996 |
| EP | 0714556 | B1 | 1/1999 |
| EP | 0889283 | A1 | 1/1999 |
| EP | 0458408 | B1 | 9/1999 |
| EP | 0578302 | B1 | 9/1999 |
| EP | 0723701 | B1 | 1/2000 |
| EP | 1000522 | B1 | 5/2000 |
| EP | 0787419 | B1 | 5/2001 |
| EP | 1145282 | B1 | 10/2001 |
| EP | 1157428 | B1 | 11/2001 |
| EP | 1195740 | A2 | 4/2002 |
| EP | 1016062 | B1 | 8/2002 |
| EP | 1195740 | A3 | 1/2003 |
| EP | 1149510 | B1 | 2/2003 |
| EP | 1056993 | B1 | 3/2003 |
| EP | 0766436 | B1 | 5/2003 |
| EP | 0924281 | B1 | 5/2003 |
| EP | 0826167 | B1 | 6/2003 |
| EP | 1147686 | B1 | 1/2004 |
| EP | 1142452 | B1 | 3/2004 |
| EP | 1145602 | B1 | 3/2004 |
| EP | 1422975 | A1 | 5/2004 |
| EP | 0890059 | B1 | 6/2004 |
| EP | 1461982 | B1 | 9/2004 |
| EP | 1502483 | B1 | 2/2005 |
| EP | 1518445 | B1 | 3/2005 |
| EP | 1348319 | B1 | 6/2005 |
| EP | 1537354 | B1 | 6/2005 |
| EP | 1037862 | B1 | 7/2005 |
| EP | 1346609 | B1 | 8/2005 |
| EP | 1576858 | B1 | 9/2005 |
| EP | 1579736 | B1 | 9/2005 |
| EP | 1321012 | B1 | 12/2005 |
| EP | 1610593 | A2 | 12/2005 |
| EP | 1624728 | A1 | 2/2006 |
| EP | 1646092 | B1 | 4/2006 |
| EP | 1415517 | B1 | 5/2006 |
| EP | 1415518 | B1 | 5/2006 |
| EP | 1438877 | B1 | 5/2006 |
| EP | 1166604 | B1 | 6/2006 |
| EP | 1479270 | B1 | 7/2006 |
| EP | 1348318 | B1 | 8/2006 |
| EP | 1399694 | B1 | 8/2006 |
| EP | 1461980 | B1 | 10/2006 |
| EP | 1763650 | B1 | 3/2007 |
| EP | 1110120 | B1 | 4/2007 |

(56) References Cited

FOREIGN PATENT DOCUMENTS

| | | | |
|---|---|---|---|
| EP | 1440604 | B1 | 4/2007 |
| EP | 1047903 | B1 | 6/2007 |
| EP | 1500307 | B1 | 6/2007 |
| EP | 0922305 | B1 | 8/2007 |
| EP | 0922306 | B1 | 8/2007 |
| EP | 1194918 | B1 | 8/2007 |
| EP | 1833035 | A1 | 9/2007 |
| EP | 1048085 | B1 | 11/2007 |
| EP | 1852648 | A1 | 11/2007 |
| EP | 1763650 | B1 | 12/2007 |
| EP | 1776722 | B1 | 1/2008 |
| EP | 1873012 | | 1/2008 |
| EP | 1459599 | B1 | 2/2008 |
| EP | 1887836 | A2 | 2/2008 |
| EP | 1889519 | | 2/2008 |
| EP | 1579733 | B1 | 4/2008 |
| EP | 2013530 | B1 | 1/2009 |
| EP | 1337784 | B1 | 6/2009 |
| EP | 2333407 | A1 | 6/2011 |
| EP | 2430888 | | 3/2012 |
| EP | 2469155 | A1 | 6/2012 |
| EP | 2554895 | A1 | 2/2013 |
| EP | 2573457 | A1 | 3/2013 |
| FR | 2813115 | | 2/2002 |
| GB | 2165977 | A | 4/1986 |
| GB | 2215024 | A | 9/1989 |
| GB | 2324901 | A | 11/1998 |
| GB | 2447257 | A | 9/2008 |
| GB | 2472345 | A | 2/2011 |
| GB | 2486410 | A | 6/2012 |
| GB | 2495647 | A | 4/2013 |
| JP | S62-241382 | A | 10/1987 |
| JP | S62-248271 | A | 10/1987 |
| JP | H05-102530 | A | 4/1993 |
| JP | 06-054289 | | 2/1994 |
| JP | 6-54103 | U | 7/1994 |
| JP | H6-54103 | | 7/1994 |
| JP | 7-249467 | | 9/1995 |
| JP | 7264036 | | 10/1995 |
| JP | 08-162677 | | 6/1996 |
| JP | H10-308536 | A | 11/1998 |
| JP | 11-135274 | A | 5/1999 |
| JP | H11-162234 | A | 6/1999 |
| JP | H11-260125 | A | 9/1999 |
| JP | 2001-238272 | A | 8/2001 |
| JP | 2001-291406 | A | 10/2001 |
| JP | 2002-141555 | A | 5/2002 |
| JP | 3098271 | U | 2/2004 |
| JP | 2004-119078 | A | 4/2004 |
| JP | 2004-273234 | A | 9/2004 |
| JP | 2004-335426 | | 11/2004 |
| JP | 2005-158363 | A | 6/2005 |
| JP | 2005-166617 | A | 6/2005 |
| JP | 2005-347214 | A | 12/2005 |
| JP | 2006-507641 | A | 3/2006 |
| JP | 2005-322866 | A | 12/2006 |
| JP | 2007-227342 | A | 9/2007 |
| JP | 3139714 | U | 2/2008 |
| JP | 2008-186758 | A | 8/2008 |
| JP | 2008-258124 | A | 10/2008 |
| JP | 2008-293753 | A | 12/2008 |
| JP | 3154200 | | 9/2009 |
| JP | 2010-15754 | | 1/2010 |
| JP | 2010-192229 | A1 | 9/2010 |
| JP | 2010-205553 | A | 9/2010 |
| JP | 5102530 | B2 | 12/2012 |
| KR | 10-2004-0008244 | A | 1/2004 |
| KR | 10-2006-0112113 | A | 10/2006 |
| KR | 20-0430022 | Y1 | 11/2006 |
| KR | 10-2006-0133784 | A | 12/2006 |
| KR | 10-2007-0063595 | A | 6/2007 |
| KR | 10-0781652 | B1 | 12/2007 |
| KR | 10-0844538 | B1 | 7/2008 |
| KR | 10-0888669 | B1 | 11/2009 |
| KR | 10-0927851 | B1 | 11/2009 |
| TW | M337036 | | 7/2008 |
| TW | M349465 | U | 1/2009 |
| WO | 9906759 | A1 | 2/1999 |
| WO | WO 99/10867 | A1 | 3/1999 |
| WO | WO 99/31560 | A2 | 6/1999 |
| WO | WO9945312 | A1 | 9/1999 |
| WO | WO9957945 | A1 | 11/1999 |
| WO | 00/01067 | A2 | 1/2000 |
| WO | 02/25842 | A2 | 3/2002 |
| WO | 02/061330 | A2 | 8/2002 |
| WO | 02/069306 | A2 | 9/2002 |
| WO | 02/091805 | A2 | 11/2002 |
| WO | WO02091805 | A2 | 11/2002 |
| WO | 02/098182 | A2 | 12/2002 |
| WO | 02/099780 | A2 | 12/2002 |
| WO | 03/026358 | A1 | 3/2003 |
| WO | 03/055273 | A2 | 3/2003 |
| WO | 03/067934 | A2 | 8/2003 |
| WO | 03/096761 | A1 | 11/2003 |
| WO | 03/0909890 | A1 | 11/2003 |
| WO | 2004/021747 | A2 | 3/2004 |
| WO | 2004/023850 | A2 | 3/2004 |
| WO | 2004/032572 | A2 | 4/2004 |
| WO | WO2004057924 | | 7/2004 |
| WO | 2004/100624 | A2 | 11/2004 |
| WO | 2005031860 | A2 | 4/2005 |
| WO | 2005/052751 | A2 | 6/2005 |
| WO | 2005/060309 | A2 | 6/2005 |
| WO | 2005/084339 | A2 | 9/2005 |
| WO | 2005/089293 | A2 | 9/2005 |
| WO | 2005/089309 | A2 | 9/2005 |
| WO | WO2005103555 | A1 | 11/2005 |
| WO | WO2005116519 | A1 | 12/2005 |
| WO | 2006/023149 | A2 | 3/2006 |
| WO | 2006044328 | A1 | 4/2006 |
| WO | WO2006046207 | A1 | 5/2006 |
| WO | WO2006056120 | A1 | 6/2006 |
| WO | 2006/093889 | A2 | 9/2006 |
| WO | WO2006095315 | | 9/2006 |
| WO | WO2006095316 | | 9/2006 |
| WO | 2006/127666 | A2 | 11/2006 |
| WO | 2006/127785 | A2 | 11/2006 |
| WO | 2006/133272 | A2 | 12/2006 |
| WO | 2006137686 | A1 | 12/2006 |
| WO | WO2007004679 | A1 | 1/2007 |
| WO | 2007/081674 | A1 | 7/2007 |
| WO | 2007/094810 | A2 | 8/2007 |
| WO | 2007090292 | A1 | 8/2007 |
| WO | WO2008027093 | A2 | 3/2008 |
| WO | WO2008061991 | A1 | 5/2008 |
| WO | WO2008018002 | A2 | 8/2008 |
| WO | WO2008110978 | A1 | 9/2008 |
| WO | WO2008129488 | | 10/2008 |
| WO | WO2008137460 | A2 | 11/2008 |
| WO | WO2009061124 | A2 | 5/2009 |
| WO | WO2009067074 | A1 | 5/2009 |
| WO | WO2009111978 | A1 | 9/2009 |
| WO | WO2009143047 | A2 | 11/2009 |
| WO | WO2010014437 | A2 | 2/2010 |
| WO | WO2010030509 | A2 | 3/2010 |
| WO | WO2010047896 | A3 | 4/2010 |
| WO | WO2010047898 | A3 | 4/2010 |
| WO | WO2010047973 | A3 | 4/2010 |
| WO | WO2010069983 | A1 | 6/2010 |
| WO | WO2010083370 | A2 | 7/2010 |
| WO | WO2010088105 | A3 | 8/2010 |
| WO | WO2010132625 | A2 | 11/2010 |
| WO | WO20100141537 | A2 | 12/2010 |
| WO | WO2011005562 | | 1/2011 |
| WO | WO2011005579 | A2 | 1/2011 |
| WO | WO2011021719 | A1 | 2/2011 |
| WO | WO2011072308 | A1 | 6/2011 |
| WO | WO2011074884 | A2 | 6/2011 |
| WO | WO2011113709 | A1 | 9/2011 |
| WO | WO2011117059 | A1 | 9/2011 |
| WO | WO2011159436 | A2 | 12/2011 |
| WO | WO2012004708 | A2 | 1/2012 |
| WO | WO2012007899 | A1 | 1/2012 |
| WO | WO20120001584 | A1 | 1/2012 |

(56) References Cited

FOREIGN PATENT DOCUMENTS

| | | | |
|---|---|---|---|
| WO | WO2012019535 | A1 | 2/2012 |
| WO | WO2012025626 | A1 | 3/2012 |
| WO | WO2012063174 | A2 | 5/2012 |
| WO | WO2012129301 | A1 | 9/2012 |
| WO | WO20121117018 | A1 | 9/2012 |
| WO | WO2012131522 | A1 | 10/2012 |
| WO | WO2012131547 | A1 | 10/2012 |
| WO | WO2013028965 | A2 | 2/2013 |
| WO | WO2013029960 | A1 | 3/2013 |
| WO | WO2013030128 | A2 | 3/2013 |
| WO | WO2013045255 | A1 | 4/2013 |
| WO | WO2013045439 | A1 | 4/2013 |
| WO | WO2013057660 | A2 | 4/2013 |
| WO | WO2013079242 | A1 | 6/2013 |
| WO | WO2013088299 | A1 | 6/2013 |
| WO | WO2013097823 | A1 | 7/2013 |
| WO | WO2013098700 | A1 | 7/2013 |
| WO | WO2013113548 | A1 | 8/2013 |
| WO | WO2013113661 | A1 | 8/2013 |
| WO | WO2013121347 | A1 | 8/2013 |
| WO | WO2013156905 | A1 | 10/2013 |

OTHER PUBLICATIONS

Experiment Electronic Ballast. Electronic Ballast for Fluorescent Lamps [online], Revised Fall of 2007. [Retrieved on Sep. 1, 1997]. Retrieved from Virginia Tech Web Page using Internet <URL: http://www.ece.vt.edu/ece3354/labs/ballast.pdf>.

Truck-Lite, LEDSelect—LED, Model 35, Clearance & Marker Lighting, [online], [retrieved on Jan. 13, 2000] Retreived from Truck-Lite Web Page using Internet <URL: http://trucklite.com/leds14.html>.

Truck-Lite, LEDSelect—LED, Super 44, Stop, Turn & Tail Lighting, [online], [retrieved on Jan. 13, 2000] Retrieved from Truck-Lite Web Page using Internet <URL: http://trucklite.com/leds2.html>.

Truck-Lite, LEDSelect—LED, Model 45, Stop, Turn & Tail Lighting [online], [retrieved on Jan. 13, 2000] Retrieved from Truck-Lite Web Page using Internet <URL: http://trucklite.com/leds4.html>.

Telecite Products & Services—Display Options, [online], [retrieved on Jan. 13, 2000] Retrieved from Telecite Web page using Internet <URL: http://www.telecite.com/en/products/options en.htm>.

Traffic Signal Products—Transportation Products Group, [online], [retrieved on Jan. 13, 2000] Retrieved from the Dialight Web Page using Internet <URL: http://www.dialight.com/trans.htm>.

LED Lights, Replacement LED lamps for any incandescent light, [online], [retrieved on Jan. 13, 2000] Retrieved from LED Lights Web Page using Internet <URL: http://www.ledlights.com/replac.htm>.

LEDtronics, LEDtronics Catalog, 1996, p. 10, LEDtronics, Torrance, California.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_L qu3922/is_200005/ai_n8899499/>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security_benefits_building_systems/>.

Phason Electronic Control Systems, Light Level Controller (LLC) case study. Nov. 30, 2004. 3 pages, Phason Inc., Winnipeg, Manitoba, Canada.

Airport International. Fly High With Intelligent Airport Building and Security Solutions [online], [retrieved on Oct. 24, 2008]. Retrieved from Airport International web page using Internet <URL: http://www.airport-int.com/categories/airport-building-and-security-solutions/fly-high-with-intelligent-airport-building-and-security-solutions.html>.

Spencer, Eugene. High Sales, Low Utilization. Green Intelligent Buildings, Feb. 1, 2007. [online]. Retrieved from Green Intelligent Buildings web page using Internet <URL: http://www.greenintelligentbuildings.com/CDA/IBT_Archive/BNP_GUID_9-5-2006_A_1000000000000056772>.

Sensor Switch, nLight Lighting Control System, [online], [retrieved on Jan. 11, 2008] Retrieved from Sensor Switch web page using Internet <URL: http://www.sensorswitch.com>.

Six Strategies, [online], [retrieved on Jan. 11, 2008] Retrieved from Encelium Technologies Inc. Web Page using Internet <URL: http://www.encelium.com/products/strategies.html>.

Lawrence Berkeley National Labratory. Lighting Control System—Phase Cut Carrier. University of California, [online] [retrieved on Jan. 14, 2008] Retrieved from Lawrence Berkeley National Labratory web page using Internet <URL: http://www.lbl.gov/tt/techs/lbnl1871.html>.

Best Practice Guide—Commercial Office Buildings—Central HVAC System. [online]. [Retrieved on Jan. 17, 2008] Retrieved from Flex Your Power Organization web page using Internet <URL: http://www.fypower.org/bpg/module.html?b=offices&m+Central HVAC Systems&s=Contr...>.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/show/section/Design/page/controls>.

Notification of Transmittal, the International Search Report and the Written Opinion of the International Searching Authority dated May 7, 2012, from the corresponding International Application No. PCT/US2011/064151.

Lawrence Berkeley National Labratory. Lighting Control System—Phase Cut Carrier. University of California, [online] [retrieved on Jan. 14, 2008] Retrieved from Lawrence Berkeley National Labratory web page using Internet <URL:http://www.lbl.gov/tt/techs/lbnl1871.html>.

LCD Optics 101 Tutorial [online]. 3M Corporation, [retrieved on Jan. 6, 2010]. Retrieved from the internet: <URL: http://solutions.3m.com/wps/portal/3M/en_US/Vikuiti1/BrandProducts/secondary/optics101/>.

Philips. Sense and Simplicity—Licensing program for LED Luminaires and Retrofits, Philips Intellectual Property & Standards, May 5, 2009.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi_qu3922/is_200005/ai_n8899499/>.

PLC-81756-AL "Fireball" Contemporary Pendant Light, [online], [retrieved on Feb. 27, 2009] Retrieved from the Arcadian Lighting Web Page using Internet <URL: http://www.arcadianlighting .com/plc-81756-al.html>.

PLC-96973-PC PLC Lighting Elegance Modern/Contemporay Pendant Light, [online], [retrieved on Feb. 27, 2009] Retrieved from the Arcadian Lighting Web Page using Internet <URL: htt://www.arcadianlighting.com/plc-96978-pc.html>.

Saha et al, "Location Determination of a Mobile Device using IEEE 802.11 Access Point Signals", May 5, 2002 in 20 pages.

Six Strategies, [online], [retrieved on Jan. 11, 2009] Retrieved from Encelium Technologies Inc. Web Page using Internet <URL: http://www.encelium.com/products/strategies.html>.

Supplementary European Search Report for corresponding European Application No. 10797603.7 mailed Aug. 5, 2013 in 5 pages.

Supplementary European Search Report for corresponding European Application No. 09822381.1 mailed Jan. 4, 2013 in 5 pages.

Supplementary European Search Report dated Feb. 22, 2012 from European Patent Application No. 09822424.9.

TELECITE Products & Services—Display Options, [online], [retrieved on Jan. 13, 2000] Retrieved from Telecite Web page using Internet <URL: http://www.telecite.com/en/products/options.en.htm>.

Traffic Signal Products—Transportation Products Group, [online]. [retrieved on Jan. 13, 2000] Retrieved from the Dialight Web Page using Internet <URL: http://www.dialight.com/trans.htm>.

(56) References Cited

OTHER PUBLICATIONS

Truck-Lite, LEDSelect—LED, Model 35, Clearance & Marker Lighting, [online], [retrieved on Jan. 13, 2000] Retrieved from Truck-Lite Web Page using Internet <URL: http://trucklite.com/leds14.html>.
Wolsey, Robert. Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.irc.rpi.edu/programs/Futures/LF-BAS/index.asp>.
Notification of Transmittal, the International Search Report and the Written Opinion of the International Searching Authority dated May 7, 2012 from the corresponding International Application No. PCT/US2011/058312.
International Search Report and Written Opinion dated Oct. 10, 2013 for the corresponding International Application No. PCT/US2013/0494257 filed Jul. 5, 2013.
International Search Report and Written Opinion dated Sep. 23, 2013 for the corresponding International Application No. PCT/US2013/049432 filed Jul. 5, 2013.
International Search Report and Written Opinion dated Aug. 13, 2013 for the responding International Application No. PCT/US2013/028669 filed Mar. 1, 2013.
International Search Report and Written Opinion dated Aug. 30, 2011 for the corresponding International Application No. PCT/US2011/029994 filed Mar. 25, 2011.
International Search Report and Written Opinion dated Feb. 15, 2013 from the corresponding International Application No. PCT/US22012/052244 filed on Aug. 24, 2012.
International Search Report and Written Opinion dated Feb. 6, 2012 from the corresponding International Application No. PCT/US2011/043524 filed on Jul. 11, 2011.
International Search Report and Written Opinion dated Sep. 30, 2011 from the corresponding International Application No. PCT/US2011/029905 filed on Mar. 25, 2011.
International Search Report and Written Opinion dated Jul. 30, 2010 from the corresponding International Application No. PCT/US2010/021448 filed on Jan. 20, 2010.
International Search Report and Written Opinion dated Apr. 30, 2010 from the corresponding International Application No. PCT/US2009/057072 filed on Sep. 16, 2009
International Search Report and Written Opinion dated Feb. 26, 2010 from the corresponding International Application No. PCT/US2009/050949 filed Jul. 17, 2009.
internahonal Search Report and Written Opinion dated Jan. 25, 2010 from the corresponding International Application No. PCT/US2009/048623 filed Jun. 25, 2009.
International Search Report and Written Opinion dated Aug. 25, 2009 from corresponding International Application NO. PCT/US2009/031049 filed Jan. 15, 2009.
International Search Report and Written Opion dated May 24, 2010 from the corresponding International Application No. PCT/US2009/060087 filed Oct. 9, 2009.
International Search Report and Written Opinion dated May 24, 2010 from the corresponding International Application No. PCT/2009/060083 filed Oct. 9, 2009.
International Search Report and Written Opinion dated Dec. 24, 2010 from the corresponding International Application No. PCT/US2010/034635 filed May 13, 2010.
International Search Report and Written Opinion dated Nov. 23, 2011 from the corresponding International Application No. PCT/US2011/042775 filed on Jul. 1, 2011.
International Search Report and Written Opinion dated Nov. 23, 2011 from the correspinding International Application No. PCT/US2011/042761 filed on Jul. 1, 2011.
International Report on Patentability dated May 5, 2001 from the corresponding International Application No. PCT/US2009/060087 filed Oct. 9, 2009.
International Search Report and Written Opinion dated Mar. 22, 2010 from the corresponding International Application No. PCT/US2009/053853 filed Aug. 14, 2009.
International Search Report and Written Opinion dated Nov. 21, 2011 from the corresponding International Application No. PCT/US2011/029932 filed on Mar. 25, 2011.
International Search Report and Written Opinion dated Jul. 17, 2009 from the corresponding International Application No. PCT/US2008/085118 filed Dec. 1, 2008.
International Search Report and Written Opinion dated Aug. 17, 2010 from the corresponding International Application No. PCT/US2010/021489 filed on Jan. 20, 2010.
Written Opinion and International Search Report of the International Search Authority Jan. 4, 2010 from the corresponding International Application No. PCT/US2009/044313 filed May 18, 2009.
Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module.html?b=offices&m+Central HVAC Systems&s=Contr . . . >.
D.N.A.-III, [online], [retrieved Mar. 10, 2009] Retrieved from the PLC Lighting Web Page using Internet <URL: http://www.piclighting.com/product_info.php?cPath=1&products_id=92>.
E20112-22 Starburst Collection, [online], [retrieved on Jul. 10, 2010] Retrieved from ET2 Contemporary Lighting using Internet <URL: http://www.et2online.com/proddetail.aspx?ItemID=E20112-22>.
E20116-18 Larmes Collection, [online], [retrieved on Jul. 10, 2010] Retrieved from ET2 Contemporary Lighting using Internet <URL: http://www.et2online.com/proddetail.aspx?ItemID=E20116-18>.
E20524-10 & E20525-10 Curva Collection, [online], [retrieved on Jul. 10, 2010] Retrieved from ET2 Contemporary Lighting using Internet <URL: http://www.et2online.com/proddetail.aspx?ItemID=E20524-10 & E20525-10>.
E20743-09 Steath Collection, [online], [retrieved on Jul. 10, 2010] Retrieved from ET2 Contemporay Lighting using Internet <URL: http://www.et2online.com/proddetail.aspx?Item ID=E20743-09>.
E22201-44 Espirit Collection, [online], [retrieved on Jul. 10, 2010] Retrieved from ET2 Contemporary Lighting using Internet <URL: http://et2online.com/proddetail.aspx?ItemID=E22201-44>.
Extended European Search Report for co-pending European Application No. 10 73 2124 mailed on Dec. 13, 2012 in 8 pages.
Extended European Search Report for co-pending European Application No. 09/22425.6 mailed on Aug. 30, 2012 in 9 pages.
Extended European Search Report for co-pending European Application No. 10797596.3 mailed on Jan. 17, 2013 in 11pages.
Extended European Search Report for co-pending European Application No. 10736237.8 mailed on Oct. 19, 2012 in 5 pages.
Extended European Search Report for co-pending European Application No. 10738925.6 mailed Oct. 1, 2012 in 7 pages.
Extended European Search Report for co-pending European Application No. 11760309 mailed on Sep. 30, 2013 in 7 pages.
Examination and Search Report mailed Jul. 2, 2012 in corresponding United Kingdom Application No. 10018896.9 in 4 pages.
Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http:securitysolutions.com/mag/security_benefits_building_systems/>.
Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 pages.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed Sep. 16, 2009.

(56) References Cited

OTHER PUBLICATIONS

International Search Report and Written Opinion dated Apr. 8, 2010 from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Dec. 13, 2010 from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.
International Search Report and Written Opinion dated May 14, 2010 from the corresponding International Application No. PCT/US2009/060085 filed Oct. 9, 2009.
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
Bose, "Modern Power Electronics, Evolution, Technology and Applications", 1992, IEEE Press, pp. 14-15.
Kularatna, "Power Electronics Design Handbook, Low-power Components and Applications", 1998, Newns, pp. 71-75.
Lighting Handbook, 8th Edition, Illuminating Engineering Society of North America, 1993, pp. 237-240.
Hodapp, "Chapter 6: Applications for High-Brightness Light-Emitting Diodes", Hodapp, Academic Press, 1997, pp. 334-336, "High Brightness Light Emitting Diodes", Stringfellow et al., volume editors.

* cited by examiner

ELECTRIC SHOCK RESISTANT L.E.D. BASED LIGHT

CROSS REFERENCE TO RELATED APPLICATIONS

This application is a continuation of U.S. patent application Ser. No. 12/126,579 filed on May 23, 2008, now U.S. Pat. No. 8,360,599.

TECHNICAL FIELD

The present invention relates to a light emitting diode (LED) based light for replacing a conventional fluorescent light in a fluorescent light fixture.

BACKGROUND

Fluorescent tube lights are widely used in a variety of locations, such as schools and office buildings. Although conventional fluorescent bulbs have certain advantages over, for example, incandescent lights, they also pose certain disadvantages including, inter alia, disposal problems due to the presence of toxic materials within the glass tube.

LED-based tube lights which can be used as one-for-one replacements for fluorescent tube lights having appeared in recent years. One such LED-based fluorescent replacement light includes LEDs mounted on an elongated circuit board in a semi-cylindrical metal housing which also serves as a heat sink for the LEDs. A U-shaped lens snaps onto the heat sink to cover the LEDs and disperse light from them.

BRIEF SUMMARY

The inventors have discovered that the LED-based fluorescent tube replacement lights with exposed metal heat sinks as described above can present a shock hazard during installation. Ballasts in some fluorescent fixtures provide up to 1000 V at 40 kHz and higher to generate the initial striking voltage necessary for starting a conventional fluorescent light. If during installation of the LED-based light one end of the LED-based light is plugged into the fluorescent fixture while power is being provided to the fixture, the ballast may detect the incomplete circuit and provide the high-frequency starting voltage designed for starting a fluorescent light to the LED-based light. The high-frequency starting voltage provided by the ballast causes a high voltage across the circuit board in the LED-based light. Because the heat sink in the LED-based light is positioned closely to the circuit board, the high-frequency starting voltage can cause parasitic capacitive coupling between the circuit board and the heat sink, thereby producing a charge in the heat sink. A person installing the LED-based light is often touching the metal heat sink, providing a ground for the charge to pass through and resulting in a significant electrical shock to the person.

The present invention eliminates the shock hazard potential present in LED-based lights of the type having exposed metal heat sinks while still providing sufficient thermal management of heat produced by the LEDs.

In one aspect, an LED-based light for replacing a conventional fluorescent light bulb in a fluorescent light fixture comprises: a tubular housing formed of a high-dielectric material and defined at least in part by a light transmitting portion; an elongate circuit board disposed within the housing; at least one LED mounted on the circuit board; an elongate heat sink disposed within the housing, the heat sink having an interior circuit board mounting surface opposing a radially outer surface, the circuit board mounted in thermally conductive relation to the circuit board mounting surface, substantially all of the radially outer surface of the heat sink in thermally conductive relation with the tubular housing for electrically insulated thermal transmission of heat generated by the at least one LED from the circuit board to an ambient environment surrounding the LED-based light; and a pair of end caps disposed on opposing ends of the housing, each end cap including at least one connector configured to physically connect the LED-based light to a conventional fluorescent light fixture.

In another aspect, an LED-based light for replacing a conventional fluorescent tube in a conventional fluorescent light fixture comprises: a tubular housing formed of a high-dielectric material, the housing having a substantially continuous circular cross section and defined at least in part by a light transmitting portion; an elongate circuit board disposed within the housing; at least one LED mounted on the circuit board; an elongate heat sink disposed within the housing, the heat sink having an interior circuit board mounting surface opposing a radially outer surface, the circuit board mounted in thermally conductive relation to the circuit board mounting surface, the housing contoured to the radially outer surface and attached in thermally conductive relation to the radially outer surface to directly isolate the radially outer surface from an ambient environment exterior of the housing from a charge occurring in the heat sink as a result of parasitic capacitive coupling between the heat sink and the circuit board resulting from a high-frequency starting voltage designed for starting a conventional fluorescent tube being applied across the circuit board while transmitting heat from the radially outer surface to the ambient environment; a light diffusing lens positioned between the at least one LED and the light transmitting portion; and a pair of end caps disposed on opposing ends of the housing, each end cap including at least one connector configured to physically connect the LED-based light to a conventional fluorescent light fixture.

In another aspect, an LED-based light for replacing a conventional fluorescent light bulb in a fluorescent light fixture comprises: a tubular housing formed of an electrically insulating material and defined at least in part by a light transmitting portion; an elongate circuit board disposed within the housing; a plurality of LEDs mounted along a length of the circuit board for emitting light through the light transmitting portion; an elongate heat sink disposed within the housing, the heat sink having a circuit board mounting surface opposing a radially outer surface, the circuit board mounted in thermally conductive relation to the circuit board mounting surface, the housing contoured to the radially outer surface and engaged in thermally conductive relation therewith for electrically insulated thermal transmission of heat generated by the plurality of LEDs from the circuit board to an ambient environment surrounding the LED-based light; and a pair of end caps disposed on opposing ends of the housing, each end cap including at least one connector configured to physically connect the LED-based light to a conventional fluorescent light fixture.

These and other aspects will be described in additional detail below.

BRIEF DESCRIPTION OF THE DRAWINGS

The description herein makes reference to the accompanying drawings wherein like reference numerals refer to like parts throughout the several views, and wherein.

DETAILED DESCRIPTION OF EMBODIMENTS OF THE INVENTION

Figure 1:
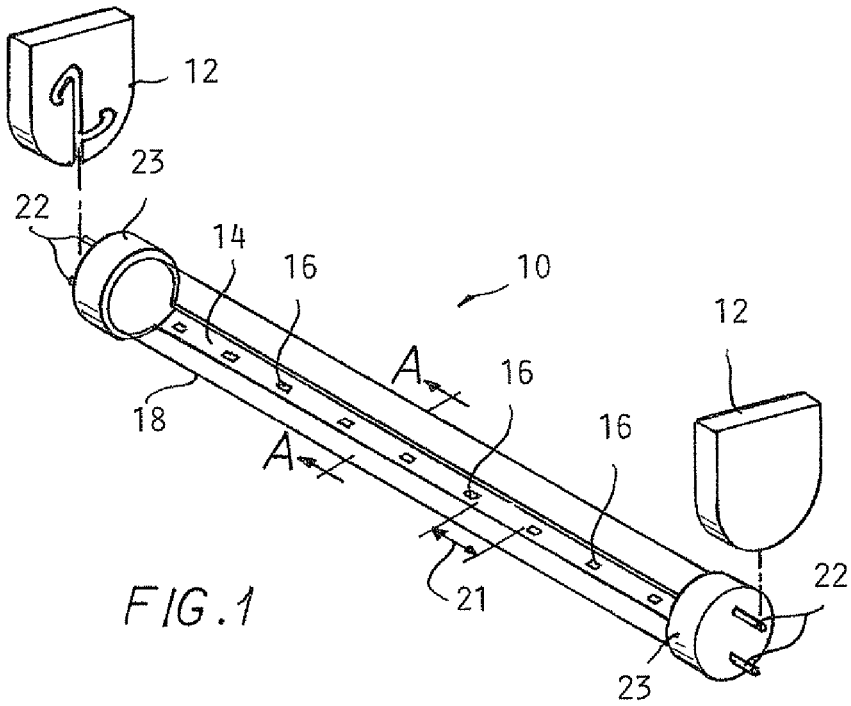
FIG. 1 is a perspective view of a LED-based replacement light in accordance with the invention and a fluorescent fixture.

FIGS. 1-11 illustrate LED-based replacement lights 10 according to the present invention for replacing a conventional fluorescent light bulb in a fluorescent fixture 12. The lights 10 each include a circuit board 14, multiple LEDs 16, a tubular housing at least partially defined by a high-dielectric translucent portion, and bi-pin electrical connectors 22 affixed to plastic end caps 23.

Figure 2:
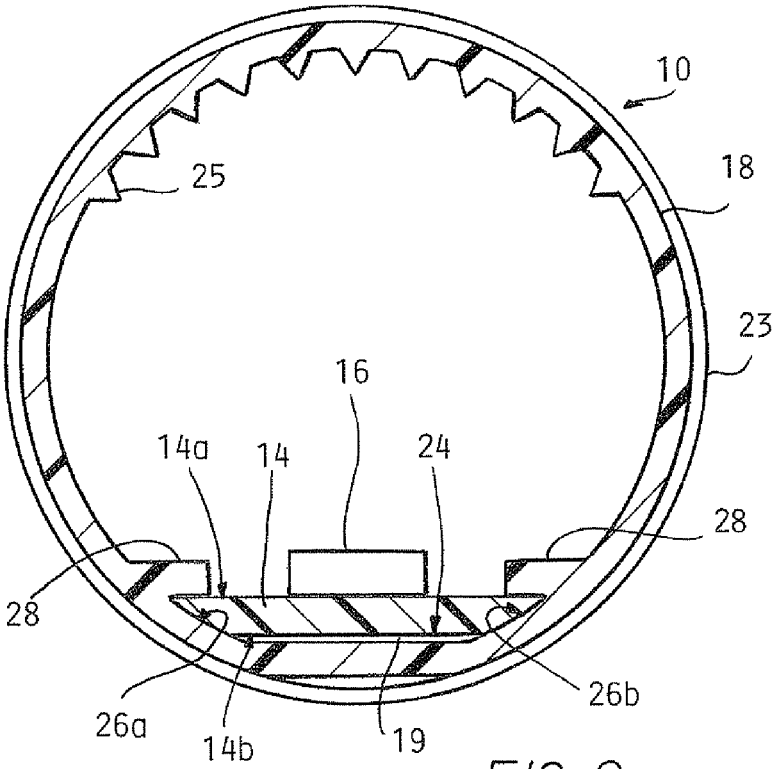
FIG. 2 is a cross-section view of the LED-based replacement light of FIG. 1 at a position similar to line A-A.

FIGS. 1 and 2 show an illustrative embodiment of the present invention in which the tubular housing consists of a tube 18. The circuit board 14 has a LED-mounting side 14*a* and a primary heat transferring side 14*b* opposite the LED-mounting side 14*a*. The circuit board 14 may be made in one piece or in longitudinal sections joined by electrical bridge connectors. The circuit board 14 and the tube 18 are in thermally conductive relation with the circuit board 14 attached to the tube 18 using highly thermally conductive adhesive transfer tape 19. The circuit board 14 can alternatively be positioned in a thermally conductive relation with the tube 18 by attaching the circuit board 14 to the tube 18 using screws, glue, a friction fit, and other attachments known to those of skill, in which cases thermal grease can be applied between the circuit board 14 and tube 18. The circuit board 14 is preferably one on which metalized conductor patterns can be formed in a process called "printing" to provide electrical connections from the connectors 22 to the LEDs 16 and between the LEDs 16 themselves. An insulative board is typical, but other circuit board types, e.g., metal core circuit boards, can alternatively be used.

The LEDs 16 are mounted at predetermined intervals 21 along the length of the circuit board 14 to uniformly emit light through a portion the tube 18. Although the LEDs 16 are shown as high-power surface-mount devices of a type available from Nichia, other types can be used. The term "high-power" means LEDs 16 with power ratings of 0.25 watts or more. Preferably, the LEDs 16 have power ratings of one watt or more. Also, although surface-mounted LEDs 16 are shown, one or more organic LEDs can be used in place of or in addition thereto.

The spacing 21 between LEDs 16 along the circuit board 14 is a function of the length of the tube 18, the amount of light desired, the wattage of the LEDs 16, and the viewing angle of the LEDs 16. For a 48" light 10, the number of LEDs 16 may vary from about thirty to sixty such that the light 10 outputs approximately 3,000 lumens, and the spacing 21 between the LEDs 16 varies accordingly. The arrangement of LEDs 16 on the circuit board 14 is such as to substantially fill the entire space between the end caps 23.

Still referring to FIGS. 1 and 2, the tube 18 includes a longitudinally extending flat interior surface 24 for supporting the circuit board 14. The surfaces 26*a* and 26*b* of the tube 18 on either side of the circuit board 14 are optionally contoured to the sides of the circuit board 14. The exterior of the tube 18 can optionally be D-shaped, with the exterior flat portion corresponding to the location of the flat interior surface 24. The tube 18 can be formed of polycarbonate, acrylic, glass, or another high-dielectric light transmitting material. As used herein, the term "high-dielectric" means a material which has a low conductivity to direct current; e.g., an insulator.

The tube 18 includes optional tabs 28 for securing the circuit board 14. The tabs 28 project from the tube 18 on opposite sides of the circuit board 14 and contact the LED-mounting side 14*a* of the circuit board 14. The tabs 28 are preferably formed integrally with the tube 18 by, for example, extruding the tube 18 to include the tabs 28. Each tab 28 can extend the entire length of the tube 18, though a series of discrete tabs 28 can alternatively be used to secure the circuit board 14.

The light 10 can include features for uniformly distributing light to the environment to be illuminated in order to replicate the uniform light distribution of a conventional fluorescent bulbs the light 10 is intended to replace. As described above, the spacing 21 of the LEDs 16 can be designed for uniform light distribution. Additionally, the tube 18 can include light diffracting structures, such as the illustrated longitudinally extending ridges 25 formed on the interior of the tube 18. Alternatively, light diffracting structures can include dots, bumps, dimples, and other uneven surfaces formed on the interior or exterior of the tube 18. The light diffracting structures can be formed integrally with the tube 18, for example, by molding or extruding, or the structures can be formed in a separate manufacturing step such as surface roughening. The light diffracting structures can be placed around an entire circumference of the tube 18, or the structures can be placed along an arc of the tube 18 through which a majority of light passes. In addition or alternative to the light diffracting structures, a light diffracting film can be applied to the exterior of the tube 18 or placed in the tube 18, or the material from which the tube 18 is formed can include light diffusing particles.

Alternatively to the tube 18 illustrated in FIGS. 1 and 2, the tube 18 can be made from a dielectric light transmitting lens portion extending at least a length and arc of the housing 18 through which the LEDs 16 emit light and a dielectric dark body portion attached to the light transmitting portion and in thermally conductive relation with the circuit board 14. Due to its dark color, the dark body portion dissipates a greater amount of heat to the ambient environment than a lighter colored body.

End caps 23 carrying bi-pin connectors 22 are attached to each longitudinal end of the tube 18 for physical and electrical connection of the light 10 to the fixture 12. Since the LEDs 16 in the present embodiment are directionally oriented, the light 10 should be installed at a proper orientation relative to a space to be illuminated to achieve a desired illumination effect. Bi-pin connectors 22 allow only two light 10 installation orientations, thereby aiding proper orientation of the light 10. While the end caps 22 are shown as cup-shaped structures that slide over longitudinal ends of the tube 18, alternative end caps that fit into the tube 18 can be used in place of the illustrated cup-shaped end caps 22. Also, only two of the four illustrated pins 22 must be active; two of the pins 22 can be "dummy pins" for physical but not electrical connection to the fixture 12. Bi-pin connectors 22 are compatible with many fluorescent fixtures 12, though end caps 23 with alternative electrical connectors, e.g., single pin end caps, can be used in place of end caps 22 carrying bi-pin connectors 23 when desired.

Positioning the circuit board 14 in thermally conductive relation with the tube 18 provides sufficient heat dissipation for the LEDs 16 to function well. In most heat transfer applications, the factor limiting the heat dissipating ability of a structure is the thermal resistance of an air film at the outer surface of the structure, necessitating the use of a highly thermally conductive metal exposed to the ambient environment in order to sufficiently dissipate heat. However, the tube 18 has such a large external surface area that the factor limiting the ability of the light 10 to dissipate heat is conduction from the LEDs 16 to the exterior of the tube 18. Positioning the primary heat transferring side 14*b* of the circuit board 14 in thermally conductive relation with the tube 18 provides sufficient heat conduction from the LEDs 16 to the exterior of the tube 18 for operation of the LEDs 16 even when the tube 18 is not constructed from a highly thermally conductive material. As a result, the tube 18 can be constructed from a low thermally conductive material.

The ability to use a low thermally conductive material for the tube 18 eliminates the shock hazard associated with capacitive coupling between the circuit board and heat sink of conventional LED-based replacement lights. Polycarbonate, acrylic, glass, and most other low thermally conductive materials from which the tube 18 can be constructed are also high-dielectric materials. Since the tube 18 in the present embodiment provides sufficient heat dissipation despite being constructed from a high-dielectric material, the light 10 need not include a highly thermally conductive structure positioned close to the circuit board 14 for dissipating heat. Thus, the light 10 as illustrated in FIGS. 1 and 2 need not include a highly electrically conductive heat sink that can be charged to a sufficient level as a result capacitive coupling to shock a person handling the light 10.

Figure 3:
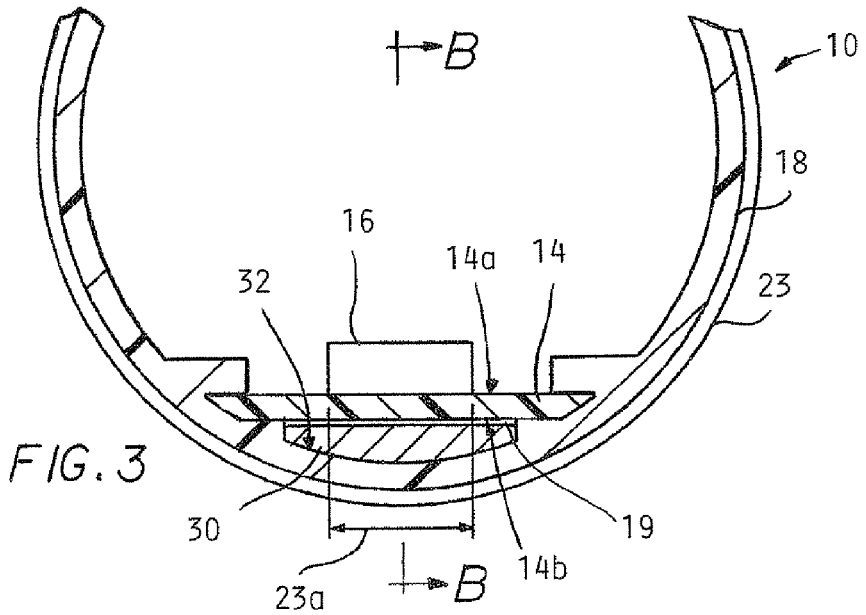
FIG. 3 is a cross-section view of another LED-based replacement light in accordance with the invention along a line similar to line A-A in FIG. 1.
Figure 4:
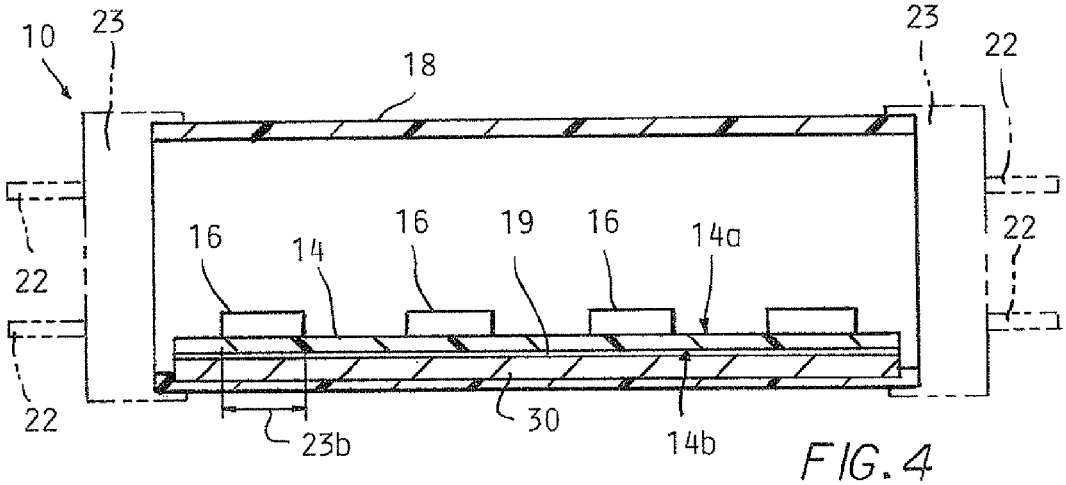
FIG. 4 is a cross-section view of the LED-based replacement light of FIG. 3 along line B-B.
Figure 5:
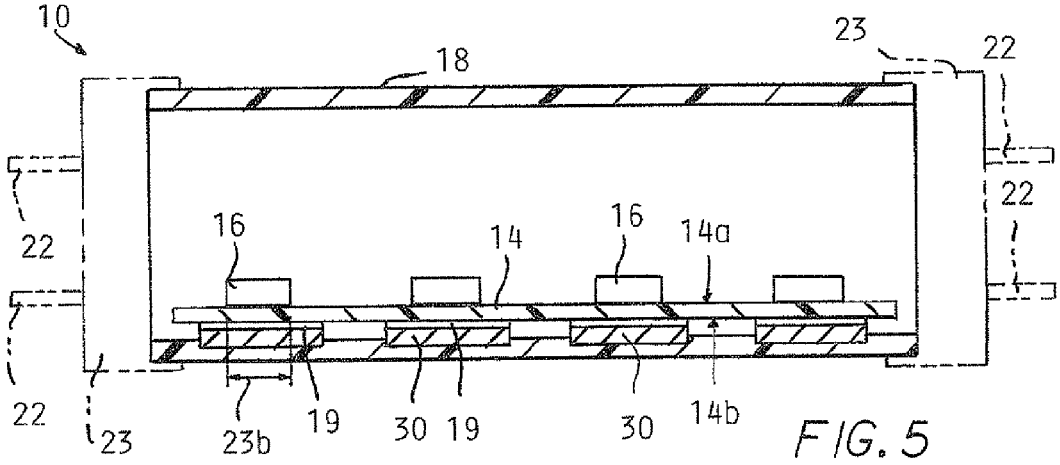
FIG. 5 is a cross-section view of another LED-based replacement light in accordance with the invention along a line similar to line B-B in FIG. 3.

FIGS. 3-5 show additional illustrative embodiments of a LED-based light 10 according to the present invention. The embodiments of the light 10 in FIGS. 3-5 are identical to the embodiment illustrated in FIGS. 1 and 2, except the lights 10 in FIGS. 3-5 includes a highly-thermally conductive heat spreader 30 in thermally conductive relation with both the primary heat transferring side 14*b* of the circuit board 14 and an interior surface 32 of the tube 18. The thermally conductive relation between the circuit board 14 and the heat spreader 30 is achieved using thermally conductive adhesive transfer tape 19 for attaching the circuit board 14 to the heat spreader 30 as shown in FIGS. 3-5, though the circuit board 14 can alternatively be attached to the heat spreader 30 using screws, glue, a friction fit, and other attachments known to those of skill, in which cases thermal grease can be applied between the circuit board 14 and heat spreader 30. The heat spreader 30 can be a continuous mass extending the length of the circuit board 14 as illustrated in FIG. 4, or multiple discrete heat spreaders 30 can be placed between areas 23 (each area 23 is the product of a width 23*a* as shown in FIG. 3 and a length 23*b* as shown in FIGS. 4 and 5) of the circuit board 14 directly underlying the LEDs 16 as illustrated in FIG. 5.

The use of a heat spreader 30 increases the thermal efficiency of the light 10 by spreading heat produced by the LEDs 16 out over a greater area of the tube 18 relative to the transferring heat directly from the circuit board 14 to the tube 18. Additionally, even though the heat spreader 30 can be formed of aluminum or another highly thermally conductive material that is also highly electrically conductive, the lights 10 of the embodiments in FIGS. 3-5 eliminate the shock hazard potential because the heat spreader 30 is enclosed by the high-dielectric tube 18. The thickness of the tube 18 is a factor of dielectric properties of the tube 18 material, the amount the heat spreader 30 can be expected to become charged due to capacitive coupling, and the amount of charge that can safely be transmitted to a person handling the light 10.

Figure 6:
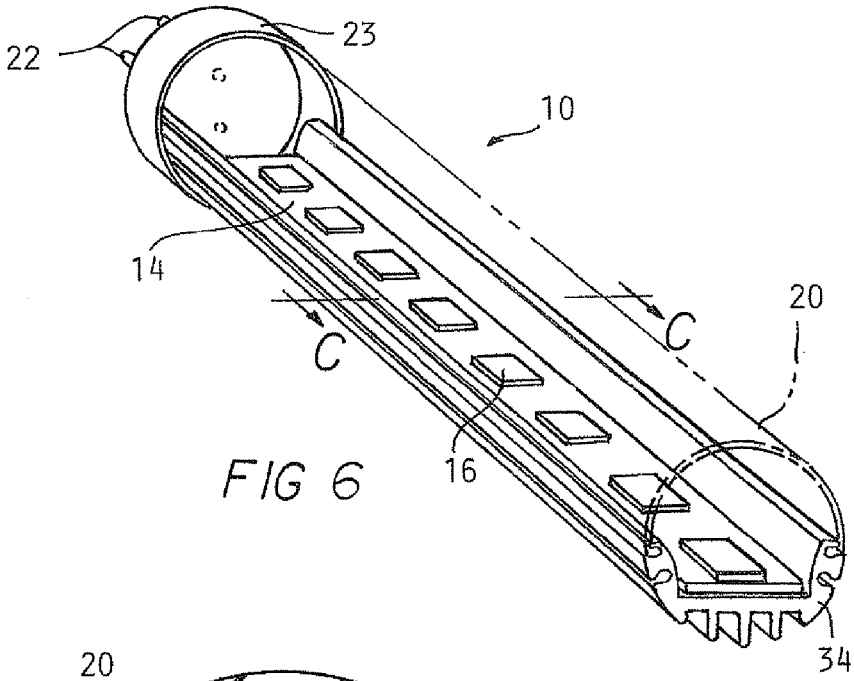
FIG. 6 is a perspective view of another LED-based replacement light with an exposed heat sink in accordance with the invention.
Figure 7:
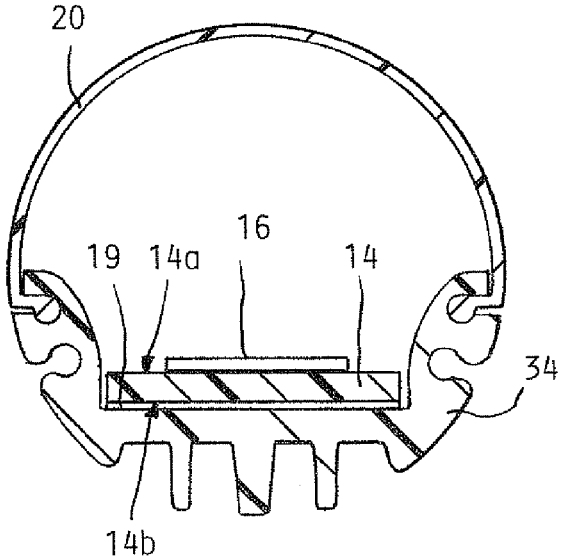
FIG. 7 is a cross-section view of the LED-based replacement light of FIG. 6 along line C-C.

FIGS. 6 and 7 show another illustrative embodiment of the present invention in which the tubular housing of the LED-based replacement light 10 is formed by engaging a high-dielectric translucent lens 20 with a highly thermally conductive, high-dielectric heat sink 34. The circuit board 14 is mounted in thermally conductive relation with the heat sink 34 by attaching the circuit board 14 to the heat sink 34 using highly thermally conductive adhesive transfer tape 19, though the circuit board 14 can also be mounted to the heat sink 34 using screws, glue, a friction fit, and other attachment methods known to those of skill in the art to achieve the desired thermally conductive relation, in which cases thermal grease can be applied between the circuit board 14 and heat sink 34.

The lens 20 can be made from polycarbonate, acrylic, glass, or another high-dielectric light transmitting material. The lens 20 can include light diffracting structures, such as the longitudinally extending ridges 25 included in the tube 18 of FIG. 2. Alternatively, light diffracting structures can include dots, bumps, dimples, and other uneven surfaces formed on the interior or exterior of the lens 20. A light diffracting film can be applied to the exterior of the lens 20 or placed between the lens 20 and heat sink 34. The lens 20 can be formed of a material including light diffusing particles. The term "lens" as used herein means a light transmitting structure, and not necessarily a structure for concentrating or diverging light.

The lens 20 and heat sink 34 can be engaged such that a large surface area of the heat sink 34 is exposed to the ambient environment. For example, the engagement between the lens 20 and heat sink 34 can be as described in U.S. application Ser. No. 12/040,901, which is hereby incorporated by reference in its entirety. Alternatively, glue, screws, tape, a snap or friction fit, or other means known to those of skill in the art can be used to engage the lens 20 with the heat sink 34.

Since the heat sink 34 is arranged in close proximity to the circuit board 14 and exposed to the ambient environment, the heat sink 34 is made from a high-dielectric material to eliminate the shock hazard potential. Moreover, it is desirable that the heat sink 34 be made from a material that is highly thermally conductive in addition to being a high-dielectric, such as a D-Series material by Cool Polymers of Warwick, R.I. The use of a highly thermally conductive, high-dielectric material allows the heat sink 34 to efficiently transfer heat to the ambient environment. To aid in heat dissipation, the heat sink 34 can include fins for increasing its surface area and heat dissipating ability. Since the heat sink 34 is highly dielectric, the light 10 can be installed one end at a time while power is being applied without becoming charged to a large enough degree to present a shock hazard to the installer.

Figure 8:
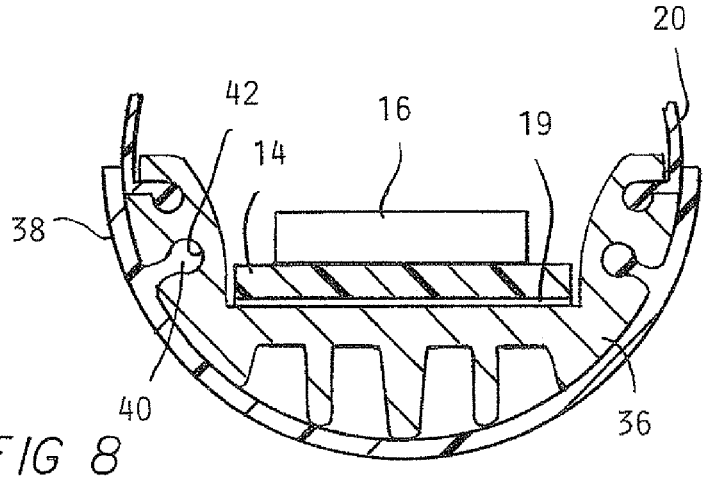
FIG. 8 is a cross-section view of another LED-based replacement light in accordance with the present invention along a line similar to line C-C in FIG. 6.
Figure 11:
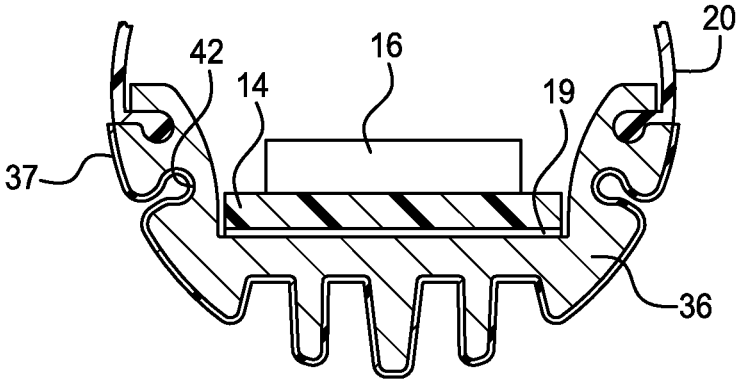
FIG. 11 is a cross-section view of another LED-based replacement light in accordance with the present invention along a line similar to line C-C in FIG. 6.

FIG. 8 is another illustrative embodiment including a heat sink 36 engaged with the lens 20. The heat sink 36 can be made from a material that is highly thermally conductive and highly electrically conductive, such as aluminum. A high-dielectric heat sink cover 38 overlays the heat sink 36 forming an exterior portion of the tubular housing. The heat sink cover 38 attaches to the heat sink 36 by slidably engaging rounded-end projections 40 formed in the cover 38 with grooves 42 formed in the heat sink 36. Alternative forms of attachment, such as screws, highly thermally conductive adhesive tape, friction fit and other attachments known to those of skill in the art are alternatively usable. Also, the cover 38 can be shaped to the contours of the heat sink 36. For example, the heat sink 36 can be coated or wrapped with a high-dielectric material. An example coating 37 is shown in FIG. 11. FIG. 11 is similar to the embodiment shown in FIG. 8. The thickness of the cover 38 is a factor of dielectric properties of the cover's 38 material, the amount the heat sink 36 can be expected to become charged due to capacitive coupling, and the amount of charge that can safely be transmitted to a person handling the light 10.

The heat sink cover 38 is preferably made of a high-dielectric and highly thermally conductive material, such as a D-Series material by Cool Polymers of Warwick, R.I., though the heat sink cover 38 need not necessarily be highly thermally conductive. With the heat sink cover 38 attached to the heat sink 36, a radially outer portion of the tubular housing consisting of the lens 20 and the cover 38 is formed of high-dielectric materials, thereby eliminating a shock hazard potential resulting from capacitive coupling of the circuit board 14 and heat sink 36.

Figure 9:
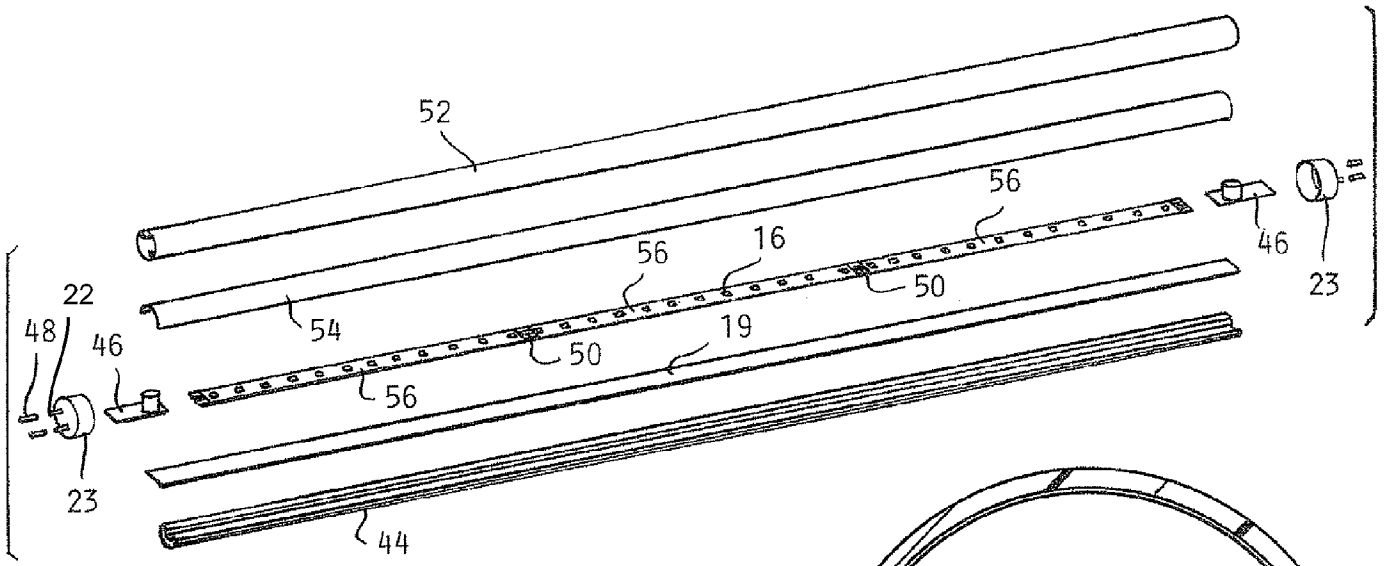
FIG. 9 is an exploded view of another LED-based replacement light in accordance with the present invention.
Figure 10:
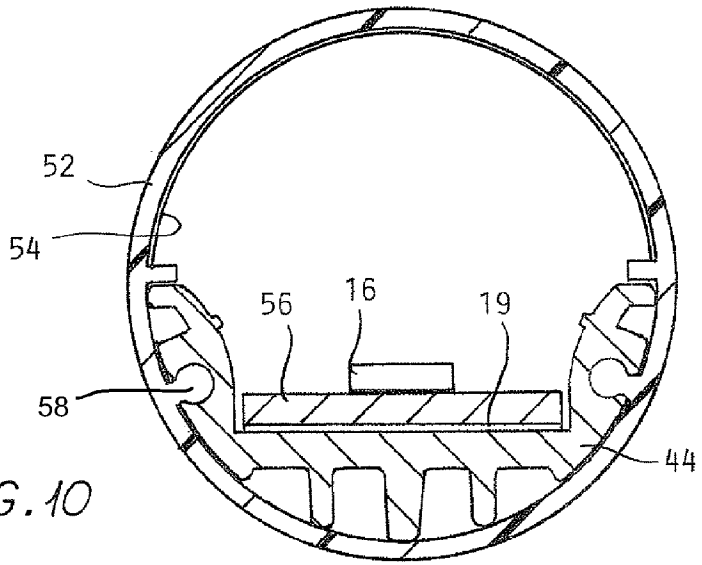
FIG. 10 is a cross-section view of the LED-based replacement light of FIG. 9 along a line similar to line C-C in FIG. 6.

FIG. 9 illustrates another embodiment of the present invention. A cylindrical high-dielectric cover 52 circumscribes a heat sink 44 and an optional bi-axially diffusing lens 54. The cylindrical cover 52 can be an approximately 0.002" thick tube of clear polycarbonate, acrylic, glass, or other high-dielectric transparent materials known to those of skill in the art. The thickness of the cover 52 can vary depending on the dielectric properties of the material from which the cover 52 is made and the expected amount of charge on the heat sink 44 in the event of capacitive coupling. Also, the thickness of the cover 52 can be designed such that the cover 52 provides structural support for the light 10, if desired. The cover 52 can include integral tabs 58 extending longitudinally, and the cover 52 can be formed by, for example, extrusion. The tabs 58 allow the heat sink 44 to be securely slidably engaged with the cover 52. Likewise, the bi-axially diffusing lens 54 can be slidably engaged on the opposing side of the tabs 58 from the heat sink 44. Alternatively, the cover 52 can be a high-dielectric layer wrapped around the heat sink 44 and lens 54.

The optional bi-axially diffusing lens 54 preferably provides approximately 15° of diffraction to approximate the appearance of a conventional fluorescent tube. Instead of a separate lens 54, other diffractive structure can be used. For example, the cover 52 can optionally include light diffracting structures, such as ridges 25, described above in relation to the tube 18. If desired, the light 10 need not include the lens 54 or any other diffractive structures.

A circuit board structure carrying high-power LEDs 16 includes multiple circuit boards 56 attached by electrical bridge connectors 50. Alternatively, the circuit board structure can include a single circuit board or other electric circuitry. The circuit board structure is attached to the heat sink 44 using highly thermally conductive adhesive transfer tape 19. The circuit board structure can alternatively be attached with screws, glue, a friction fit, and other attachments known to those of skill, in which cases thermal grease can be applied between the circuit board structure and the heat sink 44. End caps 23 carrying bi-pin connectors 22 can be slidably engaged over the ends of the cover 52, with screws 48 securing the ends caps 23 to the heat sink 44. Alternative end caps can be used as described above. Electrical components 46 can be attached to the circuit board structure in electrical communication between the pins 22 and the LEDs 16 for manipulation of the current provided by the socket 12 as necessary.

Providing the cover 52 allows the use of a highly thermally and electrically conductive heat sink 44, e.g., an extruded aluminum heat sink, because the dielectric properties of the cover 52 reduce the shock hazard potential of capacitive coupling between the circuit board structure and the heat sink 44. Additionally, the cover 52 can provide structural support.

The above-described embodiments have been described in order to allow easy understanding of the invention and do not limit the invention. On the contrary, the invention is intended to cover various modifications and equivalent arrangements included within the scope of the appended claims, which scope is to be accorded the broadest interpretation so as to encompass all such modifications and equivalent structure as is permitted under the law.

What is claimed is:

1. An LED-based light for replacing a conventional fluorescent light bulb in a fluorescent light fixture, the LED-based light comprising:

a tubular housing formed of a high-dielectric material and defined at least in part by a light transmitting portion;

an elongate circuit board disposed within the housing;

at least one LED mounted on the circuit board;

an elongate heat sink disposed within the housing, the heat sink having a circuit board mounting surface opposing a radially outer surface, the circuit board mounted in thermally conductive relation to the circuit board mounting surface, substantially all of the radially outer surface of the heat sink in thermally conductive relation with the tubular housing for electrically insulated thermal transmission of heat generated by the at least one LED from the circuit board to an ambient environment surrounding the LED-based light, wherein the housing includes at least one projection having a rounded end on an interior portion thereof and the radially outer surface of the heat sink includes at least one corresponding groove configured to engage the at least one projection to attach the heat sink to the housing; and a pair of end caps disposed on opposing ends of the housing, each end cap including at least one connector configured to physically connect the LED-based light to the fluorescent light fixture.

2. The LED-based light of claim 1, wherein the housing is configured to isolate the radially outer surface of the heat sink from the ambient environment surrounding the LED-based light from a charge occurring in the heat sink as a result of parasitic capacitive coupling between the heat sink and the circuit board resulting from a high-frequency starting voltage designed for starting a conventional fluorescent tube being applied across the circuit board.

3. The LED-based light of claim 1, wherein the housing has a substantially continuous circular cross section along a length of the housing.

4. The LED-based light of claim 1, wherein a plurality of LEDs are mounted along a length of the circuit board at predetermined intervals for uniformly emitting light through the light transmitting portion.

5. The LED-based light of claim 1, further comprising:

a lens positioned between the at least one LED and the light transmitting portion.

6. The LED-based light of claim 5, wherein the lens is configured to diffuse a light generated by the at least one LED.

7. The LED-based light of claim 1, wherein the heat sink is composed of an electrically conductive material.

8. The LED-based light of claim 1, wherein at least a portion of the housing that is in the thermally conductive relation with the radially outer surface of the heat sink is composed of a low thermally conductive material.

9. The LED-based light of claim 1, wherein the housing is composed of one of a polycarbonate, acrylic or glass material.

10. The LED-based light of claim 1, wherein the at least one connector is further configured to electrically connect the at least one LED to the fluorescent light fixture.

11. The LED-based light of claim 1, wherein the at least one connector is a bi-pin connector.

12. An LED-based light for replacing a conventional fluorescent tube in a conventional fluorescent light fixture, the LED-based light comprising:

a tubular housing formed of a high-dielectric material, the housing having a substantially continuous circular cross section and defined at least in part by a light transmitting portion;

an elongate circuit board disposed within the housing;

at least one LED mounted on the circuit board;

an elongate heat sink disposed within the housing, the heat sink having a circuit board mounting surface opposing a radially outer surface, the circuit board mounted in thermally conductive relation to the circuit board mounting surface, the housing contoured to the radially outer surface and attached in thermally conductive relation to the radially outer surface to isolate the radially outer surface from an ambient environment exterior of the housing from a charge occurring in the heat sink as a result of parasitic capacitive coupling between the heat sink and the circuit board resulting from a high-frequency starting voltage designed for starting a conventional fluorescent tube being applied across the circuit board while transmitting heat from the radially outer surface to the ambient environment, wherein the housing includes at least one projection having a rounded end on an interior portion thereof and the radially outer portion of the heat sink includes at least one corresponding groove configured to engage the at least one projection to attach the heat sink to the housing;

a light diffusing lens positioned between the at least one LED and the light transmitting portion; and a pair of end caps disposed on opposing ends of the housing, each end cap including at least one connector configured to physically connect the LED-based light to the fluorescent light fixture.

13. The LED-based light of claim 12, wherein a plurality of LEDs are mounted along a length of the circuit board at predetermined intervals for uniformly emitting light through the light transmitting portion.

14. The LED-based light of claim 12, wherein the heat sink is composed of an electrically conductive material.

15. The LED-based light of claim 12, wherein a portion of the housing that is in the thermally conductive relation with the radially outer surface of the heat sink is composed of a low thermally conductive material.

16. The LED-based light of claim 12, wherein the housing is composed of one of a polycarbonate, acrylic or glass material.

17. The LED-based light of claim 12, wherein the at least one connector is a bi-pin connector further configured to electrically connect the at least one LED to the conventional fluorescent light fixture.

* * * * *